US009972195B2

(12) United States Patent
Simon

(10) Patent No.: US 9,972,195 B2
(45) Date of Patent: May 15, 2018

(54) FALSE ALARM REDUCTION

(71) Applicant: Vivint, Inc., Provo, UT (US)

(72) Inventor: Scott Simon, Melville, NY (US)

(73) Assignee: Vivint, Inc., Provo, UT (US)

( * ) Notice: Subject to any disclaimer, the term of this patent is extended or adjusted under 35 U.S.C. 154(b) by 0 days. days.

(21) Appl. No.: 15/289,062

(22) Filed: Oct. 7, 2016

(65) Prior Publication Data

US 2018/0102045 A1 Apr. 12, 2018

(51) Int. Cl.
*G08B 29/00* (2006.01)
*G08B 29/18* (2006.01)

(52) U.S. Cl.
CPC ..... *G08B 29/185* (2013.01)

(58) Field of Classification Search
CPC ..... G08B 29/185
See application file for complete search history.

(56) References Cited

U.S. PATENT DOCUMENTS 7,248,155 B2 7/2007 Wang et al.
7,403,109 B2 7/2008 Martin
7,679,507 B2 3/2010 Babich et al.
8,779,921 B1 * 7/2014 Curtiss ..... G08B 25/009 340/506
9,013,295 B1 4/2015 Trundle et al.
2002/0177428 A1 11/2002 Menard et al.
2016/0050264 A1 * 2/2016 Breed ..... H04L 41/06 709/217
2016/0232764 A1 * 8/2016 Galvin ..... H04N 21/4143
2016/0239723 A1 * 8/2016 Ge ..... G08B 13/19615
2017/0004694 A1 * 1/2017 Dodson ..... G08B 25/006
2017/0032629 A1 * 2/2017 Fernandes ..... G10L 15/22
2017/0076582 A1 * 3/2017 Lewandowski ..... G08B 25/001

* cited by examiner

*Primary Examiner* — Erin M File
(74) *Attorney, Agent, or Firm* — Holland & Hart LLP

(57) ABSTRACT

Techniques are described for reducing false alarms related to security and automation systems. One method includes receiving a request to activate a security function associated with a automation system, initiating a first security duration after a predetermined time associated with the received request, detecting an occurrence of an event associated with the automation system during the first security duration, initiating a second security duration based on the detecting, and broadcasting a message requesting authentication credentials at a location of the automation system during the second security duration.

20 Claims, 9 Drawing Sheets

FALSE ALARM REDUCTION

BACKGROUND

The present disclosure, for example, relates to security and automation systems, and more particularly to providing techniques for reducing false alarms associated with security and automation systems.

Security and automation systems are widely deployed to provide various types of communication and functional features such as monitoring, communication, notification, and/or others. These systems may be capable of supporting communication with a user through a communication connection or a system management action.

Present security systems, e.g., for homes and commercial businesses, have become commonplace as people seek to guard themselves and their property. These security systems typically employ sensors at entry and exit points, along with interior sensors (e.g., motion detectors, sound sensors, and glass break sensors) for determining entry or exit into or out of a property.

SUMMARY

The present disclosure addresses the shortcomings of existing security and automation systems by applying parameters to events that may trigger an alarm. In some aspects, events that trigger an alarm may include, but are not limited to, a person entering and/or exiting a property during an armed state of the security and automation system. In one example, a person may activate a security and automation system for his or her property by inputting a request at a control panel located at the property. In some examples, the person may activate a function of the security and automation system by inputting a request using an application integrated with the security and automation system and executing on a portable electronic device (e.g., smartphone). In some aspects, a person may activate a function of the security and automation system using an application on an electronic device at the property or from a remote location (e.g., work office). As a result of inputting the request, a person located at the property will have a predetermined amount of time (e.g., n seconds, n minutes, where n is an integer) to exit the property before the security and automation system transitions into a secured state. However, in some cases, after exiting the property the person may re-enter the property, for example, because the person overlooked to grab a personal belonging (e.g., smartphone, car keys), or to turn off an appliance or a light. In some cases, the re-entry of the person into the property may trigger an alarm event due to the fact that the system believes the entry to be unauthorized. Because the re-entry may be authorized, however, the triggered alarm may be a false alarm that may lead to the unnecessary dispatch of emergency personnel to the property. Therefore, the above-noted example of a false alarm, among other examples, may be reduced by applying one or more techniques to the security and automation system as described herein.

A method for reducing false alarms of a security and automation system is described. The method may include receiving, via a processor of a control panel, a request to activate a security function associated with a security and automation system; initiating, via the processor of the control panel, a first security duration after a predetermined time associated with the received request; detecting, via the processor of the control panel, an occurrence of an event associated with the automation system during the first security duration; initiating, via the processor of the control panel, a second security duration based at least in part on the detecting; and broadcasting, via the processor of the control panel, a message requesting authentication credentials at a location of the automation system during the second security duration.

An apparatus for reducing false alarms of a security and automation system is described. The apparatus may include a processor, memory in electronic communication with the processor, and instructions stored in the memory. The instructions may cause the processor to receive a request to activate a security function associated with an automation system; initiate a first security duration after a predetermined time associated with the received request; detect an occurrence of an event associated with the home automation system during the first security duration; initiate a second security duration based at least in part on the detecting; and broadcast a message requesting authentication credentials at a location of the home automation system during the second security duration.

A non-transitory computer readable medium for reducing false alarms of a security and automation system is described. The non-transitory computer readable medium may store a program that, when executed by a processor, causes the processor to receive a request to activate a security function associated with an automation system; initiate a first security duration after a predetermined time associated with the received request; detect an occurrence of an event associated with the automation system during the first security duration; initiate a second security duration based at least in part on the detecting; and broadcast a message requesting authentication credentials at a location of the automation system during the second security duration.

In some embodiments of the method, apparatus, and/or non-transitory computer-readable medium described above, the message comprises any of an audio message, or a video message, or a combination thereof. Some embodiments of the method, apparatus, and/or non-transitory computer-readable medium may further include processes, features, means, and/or instructions for: performing the security function based at least in part on the first security duration, the second security duration, or a combination thereof. In some embodiments of the method, apparatus, and/or non-transitory computer-readable medium described above, initiating the second security duration based at least in part on the detecting may include suspending the first security duration.

Some embodiments of the method, apparatus, and/or non-transitory computer-readable medium may further include processes, features, means, and/or instructions for: receiving the authentication credentials during the second security duration, analyzing the authentication credentials based at least in part on comparing the authentication credentials to a set of pre-stored authentication credentials, and suspending the security function based at least in part on the analyzing. In some embodiments of the method, apparatus, and/or non-transitory computer-readable medium may further include processes, features, means, and/or instructions for: activating the security function based at least in part on the second security duration lapsing, or receiving an indication of failure to receive the authentication credentials during the second security duration, or a combination thereof.

Some embodiments of the method, apparatus, and/or non-transitory computer-readable medium may further include processes, features, means, and/or instructions for: transmitting the message to a remote device associated with the automation system, receiving a response message from the remote device, and activating the security function based at least in part on receiving the response message.

In some embodiments of the method, apparatus, and/or non-transitory computer-readable medium described above, the location of the automation system comprises a plurality of alarm zones. Some embodiments of the method, apparatus, and/or non-transitory computer-readable medium may further include processes, features, means, and/or instructions for: assigning a priority level to each alarm zone of the plurality of alarm zones.

Some embodiments of the method, apparatus, and/or non-transitory computer-readable medium may further include processes, features, means, and/or instructions for: determining that the detected event is an entry event; identifying an alarm zone associated with the entry event; and requesting the authentication credentials during the second security duration based at least in part on the alarm zone. In some embodiments of the method, apparatus, and/or non-transitory computer-readable medium described above, the alarm zone is associated with a first security parameter during the first security duration. In some embodiments of the method, apparatus, and/or non-transitory computer-readable medium described above, the alarm zone is associated with a second security parameter during the second security duration. In some embodiments of the method, apparatus, and/or non-transitory computer-readable medium described above, the first security parameter is different from the second security parameter.

Some embodiments of the method, apparatus, and/or non-transitory computer-readable medium may further include processes, features, means, and/or instructions for: receiving an indication of failure to receive the authentication credentials during the second security duration; and transmitting the message to a remote device based at least in part on the indication, the message including information associated with the identified alarm zone.

Some embodiments of the method, apparatus, and/or non-transitory computer-readable medium may further include processes, features, means, and/or instructions for: determining that the detected event is an exit event, receiving sensor data from at least one sensor associated with the automation system based at least in part on the exit event, and determining an occupancy at the location of the automation system based at least in part on the sensor data. Some embodiments of the method, apparatus, and/or non-transitory computer-readable medium may further include processes, features, means, and/or instructions for: performing the security function based at least in part on the exit event, or the occupancy, or the second security duration lapsing, or a combination thereof.

Some embodiments of the method, apparatus, and/or non-transitory computer-readable medium may further include processes, features, means, and/or instructions for: confirming an identity associated with an occupant at the location of the automation system based at least in part on the determined occupancy, and terminating the message based at least in part on the confirmed identity.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

The techniques described herein generally relate to addressing the shortcomings of existing security and automation systems. In one aspect, the techniques described herein relate to applying parameters to events that trigger an alarm associated with security and automation systems. In some aspects, events that trigger an alarm may include, but are not limited to, a person entering and/or exiting a property during an armed (i.e., secure) state of the security and automation system. In an example, a person may activate a security and automation system at his or her property by inputting a request at a device (e.g., control panel, controller) located at the property. In some examples, the person may activate the security and automation system by entering a request via an application integrated with the security and automation system. For example, a person may activate features of a security and automation system using a mobile application executing on a portable electronic device (e.g., smartphone). In some cases, a person's portable electronic device may communicate with a separate security device, such as a control panel, controller, or sensors, among others using the application running on the portable electronic device. After the security and automation system receives the request, the person or another individual at the property will have a predetermined amount of time to evacuate the property before the security and automation system transitions into a secure state. In some cases, after exiting the property the person may re-enter the property, for example, because the person overlooked to grab a personnel belonging (e.g., smartphone, car keys). The re-entry of the person into the property may trigger an alarm event. This triggered alarm may be, in some examples, a false alarm and may lead to the unnecessary dispatch of emergency personnel to the property.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
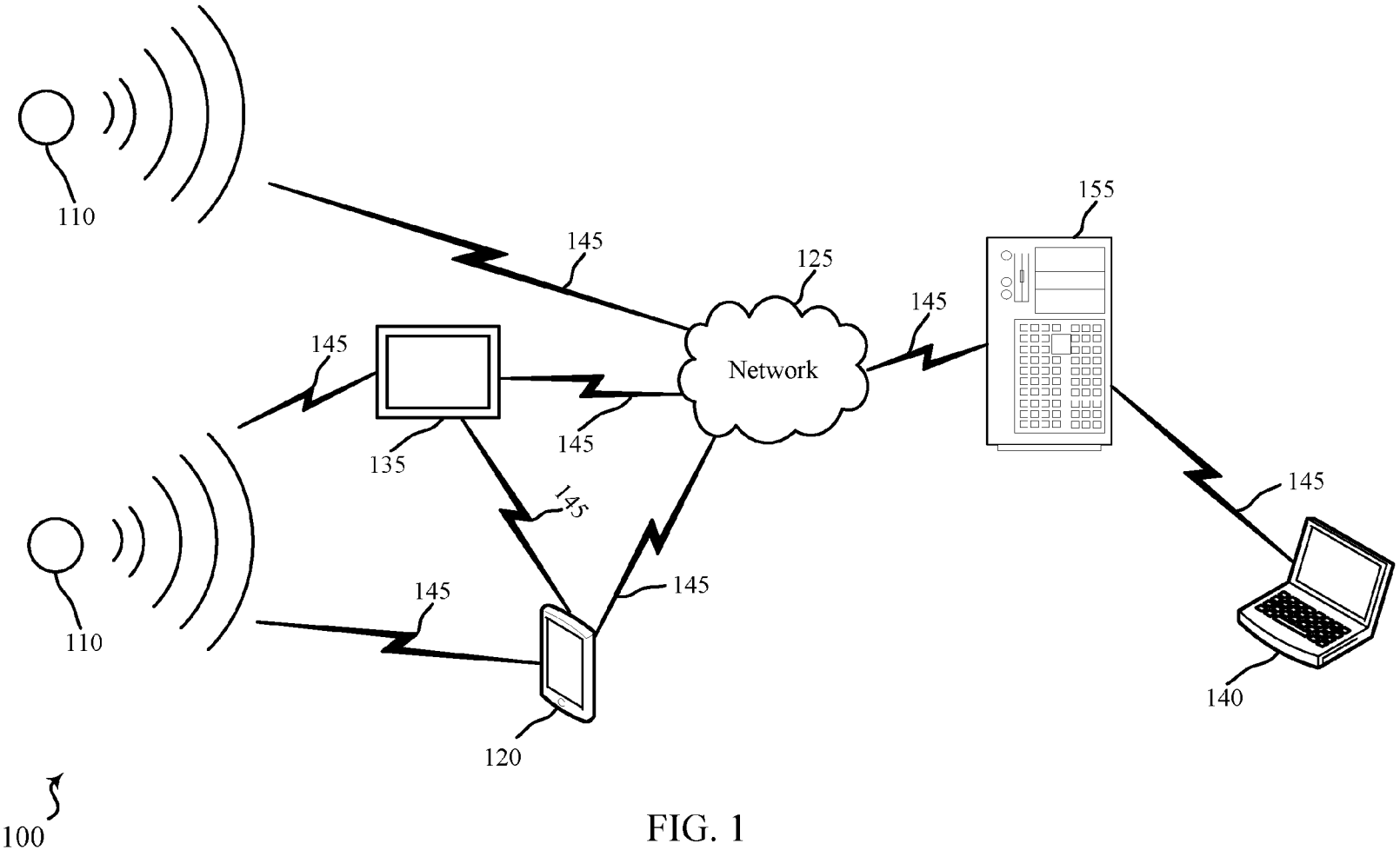
FIG. 1 shows a block diagram relating to an example security and automation system, in accordance with one or more aspects of the present disclosure.

FIG. 1 shows a block diagram relating to an example security and automation system 100, in accordance with one or more aspects of the present disclosure. The security and automation system 100 may include one or more sensor units 110, local computing device 120, control panel 135, remote computing device 140, and server 155. The network 125 may provide user authentication credentials, encryption, access authorization, tracking, Internet Protocol (IP) connectivity, and other access, computation, modification, and/or functions. The control panel 135 may interface with the network 125 through a first set of wired and/or wireless communication links 145 to communicate with the server 155. The control panel 135 may perform communication configuration, adjustment, and/or scheduling for communication with the local computing device 120 and remote computing device 140, or may operate under the control of a controller. Control panel 135 may communicate with a back end server (such as the server 155)—directly and/or indirectly—using the first set of one or more wireless communication links 145. In some examples, the server 155 may be a remote server located at a location different or same from the control panel 135, the local computing device 120, and/or the remote computing device 140.

The control panel 135 may wirelessly communicate with the remote computing device 140 and the local computing device 120 by way of one or more antennas. The control panel 135 may provide communication coverage for a respective coverage area (e.g., residential, commercial). In some examples, control panel 135 may be referred to as a control device, a controller, a base transceiver station, a radio base station, an access point, a radio transceiver, or some other suitable terminology. The coverage area for a control panel 135 may be divided into sectors making up only a portion of the coverage area. The security and automation system 100 may include control panels of different types. In some examples, the security and automation system 100 may include overlapping coverage areas for one or more different parameters, including different technologies, features, subscriber preferences, hardware, software, technology, and/or methods. For example, one or more control panels may be related to one or more discrete structures (e.g., a home, a business) and each of the one more discrete structures may be related to one or more discrete areas. In other examples, multiple control panels may be related to the same one or more discrete structures (e.g., multiple control panels relating to a home and/or a business complex). For example, one or more control panels may be located within a home. Additionally or alternatively, each room within the home may have a designated control panel located within each room. In some cases, the one or more control panels may communicate with one another via one or more communication protocols. In some examples, the one or more control panels may form a mesh network within the home and communicate with one another via the mesh network. In some examples, a control panel may modify or update a security parameter based on information received from one or more other control panels in the mesh network.

The local computing device 120 or remote computing device 140 may be dispersed throughout the security and automation system 100. In some examples, the local computing device 120 and/or remote computing device 140 may be stationary and/or mobile. In some examples, the local computing device 120 and/or remote computing device 140 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a camera, and/or the like. The local computing device 120 and/or remote computing device 140 may, additionally or alternatively, include or be referred to by those skilled in the art as a user device, a smartphone, a BLUETOOTH® device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

In some examples, control panel 135 may be a smart home system panel, for example, an interactive panel mounted on a wall or other surface in a person's home. Control panel 135 may be in direct communication via wired or wireless communication links 145 with the one or more sensor units 110, or may receive sensor data from the one or more sensor units 110 via local computing device 120 and network 125, or may receive data via remote computing device 140, server 155, and network 125. Additionally or alternatively, the control panel 135 may wirelessly communicate with the sensor units 110 via one or more antennas. The sensor units 110 may be dispersed throughout the security and automation system 100 and each sensor unit 110 may be stationary and/or mobile. Sensor units 110 may include and/or be one or more sensors that sense: proximity, motion, temperatures, humidity, sound level, smoke, structural features (e.g., glass breaking, window position, door position), time, light, geo-location data of a user and/or a device, distance, biometrics, weight, speed, height, size, preferences, light, darkness, weather, time, system performance, and/or other inputs that relate to a security and/or an automation system. The local computing device 120, remote computing device 140, and/or a sensor units 110 may be able to communicate through one or more wired and/or wireless connections with various components such as a control panel, base stations, and/or network equipment (e.g., servers, wireless communication points, etc.) and/or the like. In some examples, one or more sensor units 110 may be located within a structure, e.g., home. Additionally or alternatively, in some examples, the structure may have a designated sensor unit located within one or more predetermined areas, e.g., rooms. In some cases, the one or more sensor units 110 may communicate with one another via one or more communication protocols. In some examples, the one or more sensor units 110 may form a mesh network within the structure and communicate with one another via the mesh network. In some examples, the mesh network associated with the sensor units 110 may be different or be a part of a mesh network associated with one or more control panels.

The wireless communication links 145 shown in the security and automation system 100 may include uplink (UL) transmissions from a local computing device 120 to a control panel 135, and/or downlink (DL) transmissions, from a control panel 135 to the local computing device 120. The downlink transmissions may also be called forward link transmissions while the uplink transmissions may also be called reverse link transmissions. Wireless communication links 145 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The wireless communication links 145 may transmit bidirectional communications and/or unidirectional communications. Wireless communication links 145 may include one or more connections, including but not limited to, 345 MHz, Wi-Fi, BLUETOOTH®, BLUETOOTH® Low Energy, cellular, Z-WAVE®, 802.11, peer-to-peer, LAN, wireless local area network (WLAN), Ethernet, FireWire®, fiber optic, and/or other connection types related to security and/or automation systems.

In some aspects, of the security and automation system 100, control panel 135, local computing device 120, and/or remote computing device 140 may include one or more antennas for employing antenna diversity schemes to improve communication quality and reliability between control panel 135, local computing device 120, and remote computing device 140. Additionally or alternatively, control panel 135, local computing device 120, and/or remote computing device 140 may employ multiple-input, multiple-output (MIMO) techniques that may take advantage of multi-path, mesh-type environments to transmit multiple spatial layers carrying the same or different coded data.

While the local computing device 120 and/or remote computing device 140 may communicate with each other through the control panel 135 using wireless communication links 145, the local computing device 120 and/or remote computing device 140 may also communicate directly with one or more other devices via one or more direct communication links (not shown). Examples of direct communication links may include Wi-Fi Direct, BLUETOOTH®, wired, and/or, and other P2P group connections. The control panel 135, local computing device 120, and/or remote computing device 140 in these examples may communicate according to the WLAN radio and baseband protocol including physical and medium access control (MAC) layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within security and automation system 100.

In an example, local computing device 120 and remote computing device 140 may be custom computing entities configured to interact with sensor units 110 via network 125, and in some embodiments, via server 155. In other embodiments, local computing device 120 and remote computing device 140 may be general purpose computing entities such as a personal computing device, for example, a desktop computer, a laptop computer, a netbook, a tablet personal computer (PC), a control panel, an indicator panel, a multi-site dashboard, an iPod®, an iPad®, a smart phone, a mobile phone, a personal digital assistant (PDA), and/or any other suitable device operable to send and receive signals, store and retrieve data, and/or execute modules. The local computing device 120 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing device 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110.

The processor of the local computing device 120 may be operable to control operation of the output of the local computing device 120. The output may be a television, a liquid crystal display (LCD) monitor, a cathode ray tube (CRT) monitor, speaker, tactile output device, and/or the like. In some embodiments, the output may be an integral component of the local computing device 120. Similarly, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing device 120 to the output.

The remote computing device 140 may be a computing entity operable to enable a remote person to monitor the output of the sensor units 110. The remote computing device 140 may be functionally and/or structurally similar to the local computing device 120 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via wireless communication links 145 and server 155.

In some embodiments, the sensor units 110 may be sensors configured to conduct periodic or ongoing automatic measurements related to detecting an occurrence of an event. In some examples, the sensor units 110 may be configured to determine presence, occupancy, identity, and location based on a received request. Each sensor unit 110 may be capable of sensing multiple identification and/or location determining parameters, or alternatively, separate sensor units 110 may monitor separate identification and/or location determining parameters. For example, one sensor unit 110 may determine an identity of a person, while another sensor unit 110 (or, in some embodiments, the same sensor unit 110) may detect an occupancy of and/or location of the person.

In some embodiments, the sensor units 110 may be separate from the control panel 135 and may be positioned at various locations throughout the house or the property. In other embodiments, the sensor units 110 may be integrated or collocated with other house and/or building automation system components, home appliances, and/or other building fixtures. For example, a sensor unit 110 may be integrated with a doorbell or door intercom system, or may be integrated with a front entrance light fixture. In other embodiments, a sensor unit 110 may be integrated with a wall outlet and/or switch. In other embodiments, the sensor units 110 may be integrated and/or collocated with the control panel 135 itself. In some examples, each of the sensor units 110, control panel 135, and/or local computing device 120 may comprise a speaker unit, a microphone unit, and/or a camera unit, among other things.

In some cases, a property may be monitored by the control panel 135 and/or sensor units 110. In some examples, the control panel 135 may include sensor units 110 such that the control panel 135 may directly receive signals (e.g., motion sensed, entry/exit detected) associated with the property. Each sensor unit 110 may be capable of sensing multiple occupancy parameters, or alternatively, separate sensor units may monitor separate occupancy parameters. For example, one sensor unit may be a motion sensor, while another sensor unit may detect security parameters by monitoring vibration or audio. In some cases, sensor units 110 may additionally monitor alternate security and occupancy parameters, for example by monitoring heartbeat or breathing. In some examples, occupancy may be detected by any one of a motion sensor, audio sensor, RFID sensor, video camera, light-break sensor, or a combination thereof. In some embodiments, the sensor units 110 may be separate from the control panel 135, and may be positioned at various locations, also referred to herein as zones, throughout a property. In other embodiments, the sensor units 110 may be integrated or collocated with other security and automation system components. For example, a sensor unit 110 may be integrated with a wall, door, window for detecting entry and/or exit of a person relative to the property. In other embodiments, the sensor units 110 may be integrated or collocated with the control panel 135 itself.

In some cases, the control panel 135 in communication with the sensor units 110 may receive a request to trigger a security function associated with a home automation system. In some examples, the security function may be instructions to arm a property (i.e., activate alarm parameters). After receiving the instructions, the control panel 135 may determine one or more settings associated with the security and automation system 100. In one embodiment, the control panel 135 may initiate a predetermined time (e.g., time delay, duration, time frame) as one of the settings. The predetermined time may provide a duration where the property's security system is counting down before switching into an armed state. For example, the predetermined time may be an exit delay duration where a person is given a duration (e.g., 30 seconds) to leave the property without setting off an alarm event. In some cases, the control panel 135 may detect a person exiting the property, and based on detecting the person exiting the property, the control panel 135 may automatically initiate the predetermined time duration at that instance. For example, the control panel 135 may detect that a person exited a home based on received sensor data associated with an entry/exit door, the control panel 135 may then parse sensor data from one or more other sensors located at the property of the home to determine whether an occupancy can be detected (e.g., another person within the home). If the control panel 135 determines that no occupancy is present, the control panel 135 may automatically initiate the predetermined time. In some examples, after the predetermined time lapses, the security and automation system 100 may be in an armed state.

Additionally, in some cases, after the security and automation system 100 shifts into an armed state, the control panel 135 may initiate a first security duration. A first security duration may include, but is not limited to, a timer or counter associated with the control panel 135 that is activated after the security and automation system 100 is armed. In some cases, the first security duration may include a predetermined duration (e.g., 0 seconds to 120 seconds). In one embodiment, the first security duration may be associated with a default setting; for example, a default setting may include, but is not limited to, the predetermined duration being two minutes. In some examples, a default setting may be based on different events, locations, time of day, or date, etc. In some cases, the first security duration may be a background process of the control panel 135. In other cases, the control panel 135 may prevent broadcasting any information associated with the first security duration for example, an audible indication, or visual indication, or a combination thereof.

Additionally, in some examples, one or more alarm zones may be associated with a different settings based on a corresponding security duration. For example, during a time duration associated with the first security duration, sensor units 110 associated with one or more alarm zones at a property may not trigger an alarm event even if an alarm-triggering event is detected (e.g., motion, sound, entry/exit). In some cases, alarm zones may be assigned a priority level. In some examples, a property may include a plurality of alarm zones. In some aspects, the plurality of alarm zones may have an assigned priority level. For example, a first alarm zone may be associated with a first area of a property (e.g., a living room, kitchen, bedroom), where a second alarm zone may be associated with a second area of a property, e.g., children's bedroom. In some examples, an alarm zone may be associated with a first security parameter during a first security duration. Alternatively or additionally, an alarm zone may be associated with a second security parameter during a second security duration. For example, an entry or exit related to an alarm zone of a property during the first security duration may not trigger an alarm event. Alternatively, an entry or exit related to the same alarm zone during the second security duration may trigger an alarm event.

In some cases, one or more security functions associated with the security and automation system may be based on the identified alarm zone, the assigned priority level of the identified alarm zone, or a combination thereof. In some cases, for example, an alarm zone associated with a children's room may have different security or alarm states based on detected events (i.e., entry events during a first security duration). In some examples, an alarm zone may transition in and out of different security states based on a time of day, or detected event, among others.

In some cases, alarm events may be triggered and/or reported to a remote device based at least in part on the priority level assigned to a corresponding alarm zone. In some examples, after the first security duration lapses, the sensor units 110 associated with an alarm zone will no longer have any delay associated with the sensor units 110 and may trigger an alarm event based on detecting an event, e.g., motion within the alarm zone. Additionally or alternatively, in some cases, during a duration associated with the first security duration, a person may re-enter the property, for example, because the person forgot his wallet while exiting. As a result, the re-entry of the person into the property during the first security duration may not trigger an alarm event. In some cases, the re-entry of the person into the property during the first security duration may trigger an alarm event based at least in part on an alarm zone and/or assigned priority level of the alarm zone. For example, if a person re-enters the property and the sensor units 110 detect entry via an authorized entry point, such as a main entrance of a property, the security and automation system will not trigger an alarm event. However, in some cases, if a person re-enters the property and the sensor units 110 detect entry via an unusual or unauthorized entry point, such as a window of a property, the security and automation system will trigger an alarm event during the first security duration. In some examples, when the control panel 135 detects an entry into the property during a duration of the first security duration, the control panel 135 may initiate a second security duration.

A second security duration may include, but is not limited to, a timer associated with the control panel 135 that is activated after the security and automation system 100 detects entry into a property during the first security duration. In some cases, the second security duration may include a predetermined duration (e.g., 0 seconds to 120 seconds). In one embodiment, the second security duration may be associated with a default setting. A default setting, for example, may include that the predetermined duration be two minutes.

In some examples, a duration associated with the first security duration and/or second security duration may be dynamically updated by the control panel 135 based on behavioral patterns of one or more people associated with the property. For example, the security and automation system may determine, based on behavioral patterns, that individuals associated with a property require additional time compared to the default setting (e.g., two minutes) to exit a property after requesting arming of the security and automation system. As a result, the control panel 135 may adjust the default setting associated with receiving a request to arm the security and automation system.

In some cases, the execution and initiation of the second security duration may be a background process of the control panel 135. Alternatively, the control panel 135 may broadcast or display information associated with the second security duration. For example, the control panel 135 may display a timer and/or display a prompt on a disarm screen via the control panel 135. In some embodiments, the control panel 135 may broadcast an audible message associated with the second security duration based on detecting an entry into the property. For example, after detecting entry into the property, the control panel 135 may display and/or broadcast a message, e.g., "Disarm System Now". In some examples, broadcasting the message may be based on the corresponding alarm zone and/or priority assigned to the alarm zone.

In further embodiments, the one or more settings associated with initiating or triggering an alarm event may be based at least in part on alarm zones associated with a property. In some cases, an alarm zone may be associated with a room or location at the property. For example, one or more settings (e.g., first security duration or second security duration) may be initiated based on detecting a presence, motion, sound, etc., within a corresponding alarm zone. In other examples, the control panel 135 in communication with sensor units 110 may initiate one or more settings based at least in part on detecting a proximity of a person relative to an alarm zone. In some embodiments, the one or more settings of the security and automation system 100 may be initiated based on detecting a movement, e.g., walking direction, of a person relative to the alarm zone. For example, the control panel 135 in conjunction with the sensor units 110 communicate with one another via wireless communication links 145 and monitors a direction associated with a person after detecting entry into or exiting out of an alarm zone. In other embodiments, a first security duration, second security duration, or a combination thereof may be specific to one or more alarm zones within or outside a property. In some cases, a first security duration may correspond to a first security state (e.g., armed or disarmed) or parameter of the security and automation system. In another aspect, a second security duration may correspond to a second security state or parameter of the security and automation system. In some cases, the first security state or parameter and the second security state or parameter may be different and/or same.

In some embodiments, data gathered by the sensor units 110 may be communicated to local computing device 120, which may be a thermostat or other wall-mounted input/output smart home display. In other embodiments, local computing device 120 may be a personal computer or smart phone. Where local computing device 120 is a smart phone, the smart phone may have a dedicated application directed to transmitting a request to activate or deactivate a security function of the security and automation system 100. In some embodiments, local computing device 120 may communicate with remote computing device 140 or control panel 135 via network 125 and server 155. Examples of network 125 may include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 120 from remote computing device 140. For example, in some embodiments, remote computing device 140 may include a mobile application that interfaces with one or more functions of local computing device 120 or control panel 135.

The server 155 may be configured to communicate with the sensor units 110, the local computing device 120, the remote computing device 140 and control panel 135. The server 155 may perform additional processing on signals received from the sensor units 110 or local computing device 120, or may simply forward the received information to the remote computing device 140 and control panel 135. Additionally or alternatively, server 155 may be a computing device operable to receive data streams (e.g., from sensor units 110 and/or local computing device 120 or remote computing device 140), store and/or process data, and/or transmit data and/or data summaries (e.g., to remote computing device 140). For example, server 155 may receive identification data from a sensor unit 110 and location data from the same and/or different sensor units 110. In some embodiments, server 155 may "pull" the data (e.g., by querying the sensor units 110, the local computing device 120, and/or the control panel 135). In some embodiments, the data may be "pushed" from the sensor units 110 and/or the local computing device 120 to the server 155. For example, the sensor units 110 and/or the local computing device 120 may be configured to transmit data as it is generated by or entered into that device. In some instances, the sensor units 110 and/or the local computing device 120 may periodically transmit data (e.g., as a block of data or as one or more data points).

The server 155 may include a database (e.g., in memory) containing location, identification and/or authentication data received from the sensor units 110 and/or the local computing device 120. Additionally, as described in further detail herein, software (e.g., stored in memory) may be executed on a processor of the server 155. Such software (executed on the processor) may be operable to cause the server 155 to monitor, process, summarize, present, and/or send a signal associated with resource usage data.

Figure 2:
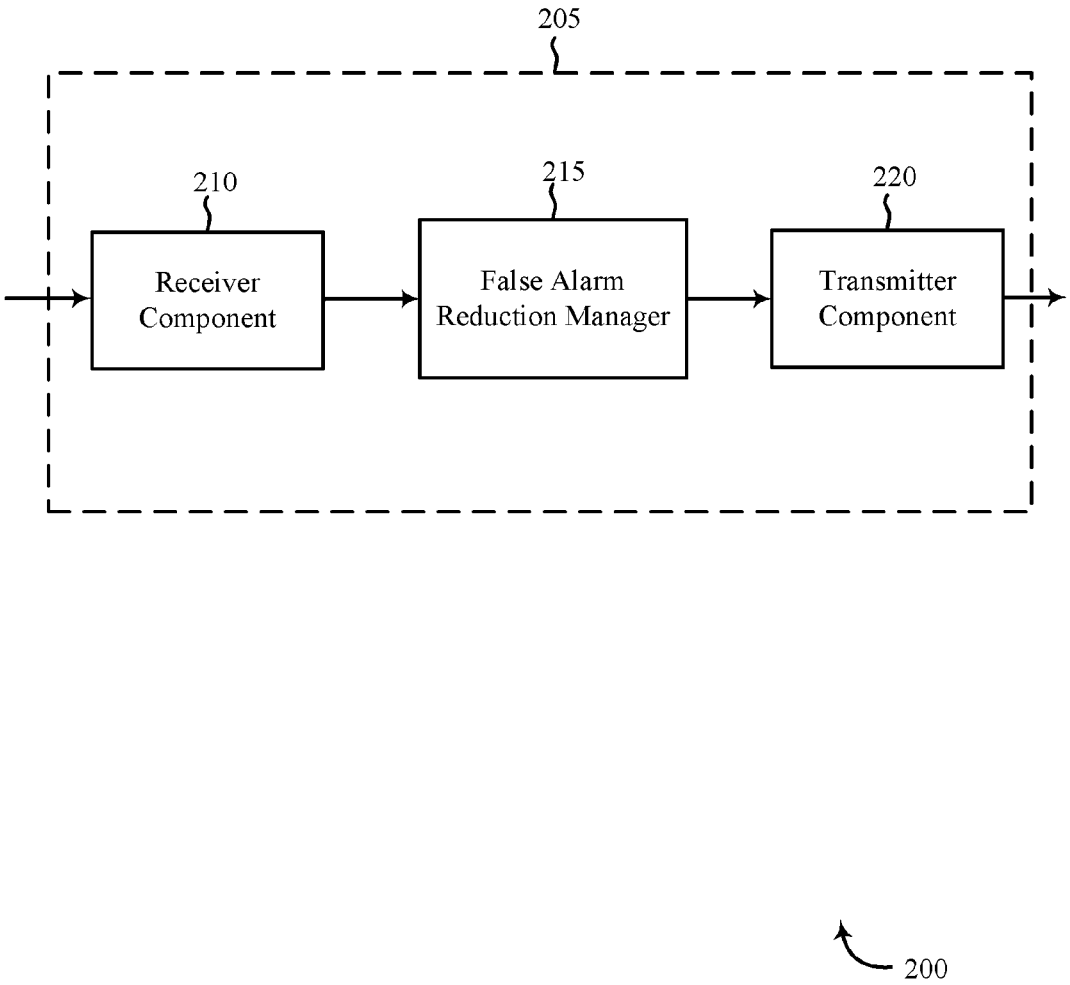
FIG. 2 shows a block diagram of an example apparatus relating to a security and automation system, in accordance with one or more aspects of the present disclosure.

FIG. 2 shows a block diagram 200 of an example apparatus 205 relating to a security and automation system, in accordance with one or more aspects of the present disclosure. The apparatus 205 may be an example of one or more aspects of a control panel 135 described with reference to FIG. 1. The apparatus 205 may include a receiver component 210, a false alarm reduction manager 215, and/or a transmitter component 220. The apparatus 205 may also be or include a processor. Each of these components or modules may be in communication with each other—directly and/or indirectly.

In one embodiment, where apparatus 205 is a control panel, apparatus 205 may be a control panel in the form of an interactive home automation system display. In some embodiments, apparatus 205 may be a local computing device 120 such as a personal computer or portable electronic device (e.g., smart phone, smart watch, tablet computer). In some embodiments, apparatus 205 may be coupled to at least one sensor unit 110.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver component 210 may receive information such as packets, user data, and/or control information associated with various information channels (e.g., control channels, data channels, etc.). In some examples, the receiver component 210 may be configured to receive instructions at the apparatus 205. In one aspect, the receiver component 210 may be configured to receive an instruction from local computing device 120 and/or remote computing device 140. In some examples, the received instruction may be in the form of a verbal command and/or a tactile input. In further examples, the receiver component 210 may receive identification information, location information and/or authentication credentials from the sensor units 110, local computing device 120, remote computing device 140, and/or server 155. In some examples, information (e.g., authentication credentials, location information) may be passed on to the false alarm reduction manager 215, and to other components of the apparatus 205.

The false alarm reduction manager 215 may reduce and prevent triggering false alarms of a security and automation system. In some cases, a property may be monitored by the apparatus 205 and/or in conjunction with the sensor units 110. In some examples, the apparatus 205 may include sensor units 110 such that the apparatus 205 may directly receive signals (e.g., motion sensed, entry/exit detected) associated with the property. Apparatus 205 may additionally, individually or in combination with other sensor units, monitor separate and/or multiple occupancy parameters. For example, apparatus 205 may include a sensor unit 110, such as a motion sensor, where a separate, remote sensor unit may vibration or audio. In some embodiments, the sensor units 110 may be separate from the apparatus 205, and may be positioned at various locations or zones throughout a property.

In some cases, the false alarm reduction manager 215 may be in communication with the sensor units 110. The false alarm reduction manager 215 may receive a request to activate a security function associated with a home automation system. In some examples, the security function may be instructions to arm the property (i.e., activate alarm parameters, set an alarm system to a secured state). After receiving the request, the false alarm reduction manager 215 may determine one or more settings (e.g., a first security duration, second security duration, transmit a message to remote device) associated with the home automation system. In one aspect, the false alarm reduction manager 215 may initiate a first security duration after the passage of a predetermined time associated with the received request. The predetermined time may provide a time duration where the property's security system is not in an armed state.

In some cases, the false alarm reduction manager 215 may detect an occurrence of an event associated with the home automation system during the first security duration. The event may include, but is not limited to, a person re-entering the property. In some examples, after detecting the event, the false alarm reduction manager 215 may initiate a second security duration based at least in part on the detecting. In some examples, initiating the second security duration based at least in part on the detecting comprises suspending the first security duration. Additionally, the false alarm reduction manager 215 may broadcast a message requesting the input of authentication credentials at a location of the home automation system during the second security duration. In some examples, the false alarm reduction manager 215 may provide a type of interface (e.g., based on a type of portable electronic device) with the person in possession of the portable electronic device required in order to obtain the level of authentication needed to authenticate. In further examples, authentication credentials includes receiving an input entered on a portable electronic device or control panel in response to the message.

In one example, false alarm reduction manager 215 in communication with the sensor units 110 may receive commands from a person to arm a room, a set of rooms, or a building. The false alarm reduction manager 215 may initiate a predetermined delay duration. The predetermined delay duration may provide a time duration where the structure's security system is transitioning into an armed state. In some cases, after the duration associated with the predetermined delay concludes, a security and automation system may switch to a full armed state. After expiration of the predetermined delay duration, the false alarm reduction manager 215 may initiate the first security duration. In some cases, during a time duration associated with the first security duration, sensor units 110 associated with one or more alarm zones may suspend or halt any trigger of an alarm event if any event is detected (e.g., motion, sound, entry/exit). For example, these alarm zones may be bypass zones that are unprotected and will not result in triggering of an alarm responsive to an event occurring at one of the bypass zones. In some examples, an alarm zone may be associated with a first security parameter during a first security duration. Alternatively or additionally, an alarm zone may be associated with a second security parameter during a second security duration. For example, an entry or exit related to an alarm zone of a property during the first security duration may not trigger an alarm event. Alternatively, an entry or exit related to the same alarm zone during the second security duration may trigger an alarm event.

For example, after the duration of the first security duration completes, the sensor units 110 associated with an alarm zone will no longer have any time delay associated with the alarm zone. As a result, the false alarm reduction manager 215 may trigger an alarm event based on detecting an event (e.g., motion within the alarm zone). For example, a person may arm the room(s) or building via the false alarm reduction manager 215. In some cases, the first security duration and/or a second security duration may be a predetermined amount of time allotted to disarm the security system after the system is initially armed. In some cases, if a timer associated with the first security duration expires with no events detected, (e.g., entry into the property), then the security and automation system 100 will continue to be in armed state. If the false alarm reduction manager 215 detects entry and/or exit relative to an alarm zone during the first security duration, the false alarm reduction manager 215 may initiate the second security duration. In some cases, the first security duration may be suspended by the false alarm reduction manager 215 after initiating the second security duration.

In some examples, during the second security duration, the false alarm reduction manager 215 may display a message at the control panel 135. In some cases, the false alarm reduction manager 215 may broadcast a visual message, an audible message, or a combination thereof, via the control panel 135. In further cases, the false alarm reduction manager 215 may broadcast an alarm sound associated with the second security duration. If during a time duration associated with the second security duration a person disarms the security and automation system, the false alarm reduction manager 215 will not trigger an alarm event. For example, a person may enter through an entry/exit barrier (e.g., front door, back door, garage door, window) without triggering an alarm as long as the person entering disarms the security and automation system within the second security duration. In some embodiments, a person may disarm the security and automation system via a mobile device carried by the person within the property. In some cases, an alarm zone may be violated at an instant that the first security duration expires, for example, a door opening at the property at the instant that the first security duration expires. As a result, the false alarm reduction manager 215 may initiate a false alarm error message. In some cases, the false alarm error message may include the false alarm reduction manager 215 initiating an audible alarm to sound and an second security duration to initiate. If the security and automation system is not disarmed before the second security duration expires then the false alarm reduction manager 215 may initiate a second audible alarm to sound.

Additionally or alternatively, if the false alarm reduction manager 215 does not receive instructions to disarm the security and automation system, the false alarm reduction manager 215 may trigger an alarm event. In some cases, the alarm event may include the false alarm reduction manager 215 sending a message to the local computing device 120 and/or the remote computing device 140 associated with the property and/or emergency personnel. In some cases, the message may include information associated a location of an event detected relative to the property. For example, a location associated with a detected entry (e.g., window, door) into the property.

In some embodiments, the false alarm reduction manager 215 may send a notification to the local computing device 120 and/or remote computing device 140 of a person associated with the property after initiating the second security duration. In some cases, the notification may be associated with an application operating on the local computing device 120 and/or remote computing device 140 carried by the person. If the person opens the notification within the application and confirms the intent, i.e., entry into the property, of the second security duration, the false alarm reduction manager 215 may disarm the security and automation system associated with the structure or property. In some cases, if the person does not open the notification within the application, the false alarm reduction manager 215 may continue to process the second security duration before triggering an alarm event. In some cases, the person may activate an audible alarm sound at the property via the application running on the local computing device 120 and/or remote computing device 140. In some examples, an application running on a portable electronic device may allow the person to control (either directly or via control panel 135) an aspect of the monitored property, including security, energy management, locking or unlocking a door, checking the status of a door, locating a user or item, controlling lighting, thermostats, or cameras, receiving notifications regarding a current status or anomaly associated with a home, office, place of business, and the like.

In some examples, false alarm reduction manager 215 may send a notification to the local computing device 120, remote computing device 140, or some other remote device (e.g., security monitoring center) associated with a person of the property, after detecting an event (i.e., a door opening). In some embodiments, the notification may be sent to the person based on whether the system is recently armed (e.g., within the last two minutes), whether the detected event is within a particular alarm zone, or a combination thereof. In some cases, the notification may be a message for the person associated with the property to confirm a status (e.g., authorized entry, emergency, false alarm condition) at the structure or property. In some cases, the false alarm reduction manager 215 may receive a confirmation from a device associated with the person and automatically disarm the security system without waiting for a duration associated with the first security duration or the second security duration to expire.

The transmitter component 220 may transmit the one or more signals received from other components of the apparatus 205. The transmitter component 220 may transmit information collected by sensors such as actions or behaviors, times of entry or exits associated with a property, and the like. In some examples, the transmitter component 220 may be collocated with the receiver component 210 in a transceiver module.

Figure 3:
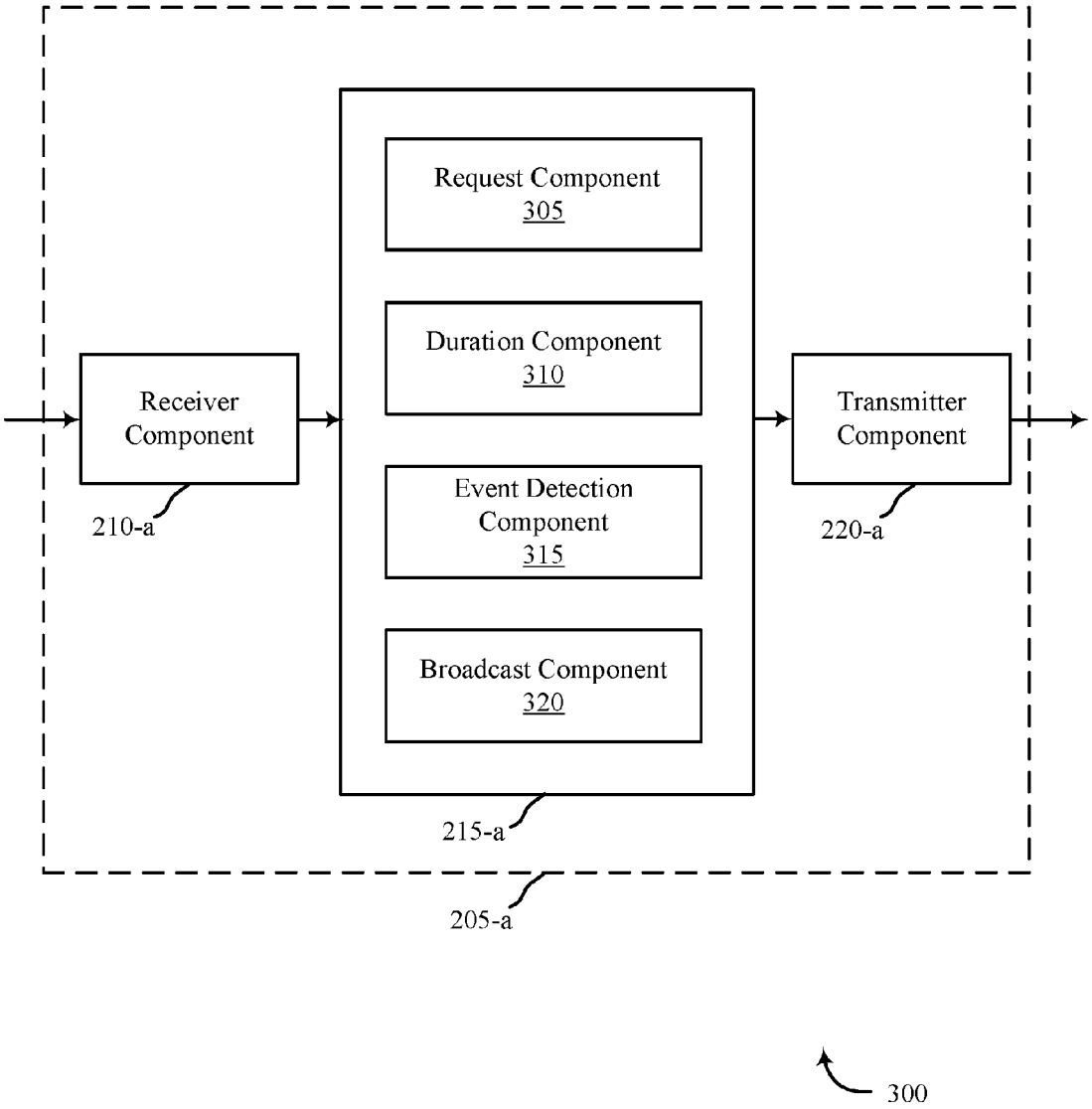
FIG. 3 shows a block diagram relating to an example security and automation system, in accordance with one or more aspects of the present disclosure.

FIG. 3 shows a block diagram 300 relating to an example a security and automation system, in accordance with one or more aspects of the present disclosure. The apparatus 205-*a* may be an example of one or more aspects of a control panel 135 described with reference to FIG. 1. The apparatus 205-*a* may include a receiver component 210-*a*, a false alarm reduction manager 215-*a*, and/or a transmitter component 220-*a*. The apparatus 205-*a* may also be or include a processor. In some aspects, apparatus 205-*a* may be an example of one or more aspects of apparatus 205 described with reference to FIG. 2. Each of these components or modules may be in communication with each other—directly and/or indirectly. In one embodiment, where apparatus 205-*a* is a control panel, apparatus 205-*a* may be a control panel in the form of an interactive home automation system display. In some embodiments, apparatus 205-*a* may be a local computing device 120 such as a personal computer or portable electronic device (e.g., smart phone, smart watch, tablet computer). In some embodiments, apparatus 205 may be coupled to at least one sensor unit 110.

In some examples, the false alarm reduction manager 215-*a*, may include request component 305, duration component 310, event detection component 315, and/or broadcast component 320. In some aspects, the false alarm reduction manager 215-*a* may be an examples of one or more aspects of false alarm reduction manager 215 described with reference to FIG. 2. The components of the apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver component 210-*a* may receive information such as packets, user data, and/or control information associated with various information channels (e.g., control channels, data channels, etc.). In some examples, the receiver component 210-*a* may be configured to receive instructions at the apparatus 205-*a*. In one aspect, the receiver component 210-*a* may be configured to receive instruction from local computing device 120 and/or remote computing device 140. In some examples, the received instruction may be in the form of a verbal command or tactile input. In further examples, the receiver component 210-*a* may receive identification information, location information and/or authentication credentials from the sensor units 110, local computing device 120, remote computing device 140, and/or server 155. In some examples, information (e.g., authentication credentials, location information) may be passed on to the false alarm reduction manager 215-*a*, and to other components of the apparatus 205-*a*. In some aspects, the receiver component 210-*a* may be an example of one or more aspects of the receiver component 210-*a* described with reference to FIG. 2.

In some examples, the request component 305 may receive a request to activate a security function associated with a home automation system. In some examples, the security function may be instructions to arm the property (i.e., activate alarm parameters). After receiving the instructions, the request component 305 may forward one or more message to other components associated with the security and automation system for performing activating the security function. In some examples, the duration component 310 may initiate a predetermined time (e.g., time delay) as one of the settings. The predetermined time may provide a duration where the security and automation system is counting down before switching into an armed state.

In some cases, the duration component 310 may receive information associated with detecting a person exiting the property, and based on detecting the person exiting the property, the duration component 310 may initiate the predetermined time duration at the instance of exit. In some examples, after predetermined time lapses, the security and automation system may be in an armed state. Additionally, in some cases, after the security and automation system switches into an armed state, the duration component 310 may initiate a first security duration. A first security duration may include, but is not limited to, a timer or counter associated with the control panel 135 that is activated after the security and automation system is armed. In some cases, the first security duration may include a predetermined duration (e.g., 0 seconds to 120 seconds). In one embodiment, the first security duration may be associated with a default setting. For example, a default setting may include, but is not limited to, the predetermined duration being two minutes. In other cases, broadcasting of any information associated with the first security duration (e.g., an audible and/or visual indication) may be prevented and/or temporarily seized.

In some examples, the event detection component 315 may detect an occurrence of an event associated with the home automation system during the first security duration. Additionally, in some examples, one or more alarm zones may be associated with a different settings based on a corresponding security duration. For example, during a duration associated with the first security duration, event detection component 315 associated with one or more alarm zones at a property may not trigger an alarm event even if an event is detected (e.g., motion, sound, entry/exit). Alternatively, in other embodiments, after the duration of the first security duration expires, the event detection component 315 associated with an alarm zone will no longer have any delay associated with it and may trigger an alarm event based on detecting an event (e.g., motion within the alarm zone). Additionally or alternatively, in some cases, during a duration associated with the first security duration, a person may re-enter the property, for example, because the person forgot to turn off an appliance, a light, or forgot to pick up a personal item while exiting. As a result, the re-entry of the person into the property during the first security duration may not trigger an alarm event. In some examples, one or more sensor units 110 and/or control panels 135 may be assigned to various alarm zones. For example, a sensor unit 110 and/or control panel 135 may be assigned to an entry/exit door, while a second sensor unit 110 and/or control panel 135 may be assigned to windows in a bedroom.

In some examples, when the event detection component 315 detects an entry into the property during a duration of the first security duration, the duration component 310 may initiate a second security duration. A second security duration may include, but is not limited to, a timer or counter that is activated after the event detection component 315 detects entry into a property after arming the system. In some cases, the second security duration may include a predetermined duration (e.g., 0 seconds to 120 seconds). In one embodiment, the second security duration may be associated with a default setting. A default setting, for example, may include that the predetermined duration be two minutes.

In some examples, the broadcast component 320 may broadcast a message requesting input of authentication credentials at a location of the home automation system during the second security duration. In another example, the message requesting authentication credentials may be satisfied passively, such as by detection of an electronic device, a radio frequency identification chip, a biometric scanner, etc. For example, the control panel 135 may display a timer and a screen which may prompt a request to confirm disarming. In some embodiments, the control panel 135 may broadcast an audible message associated with the second security duration based on detecting an entry into the property. For example, after detecting entry into the property, the control panel 135 may display and/or broadcast a message, e.g., "Disarm System Now".

The transmitter component 220-*a* may transmit the one or more signals received from other components of the apparatus 205-*a*. The transmitter component 220-*a* may transmit information collected by sensors such as actions or behaviors, times of entry or exits associated with a property, and the like. In some examples, the transmitter component 220-*a* may be collocated with the receiver component 210-*a* in a transceiver module. In some aspects, transmitter component 220-*a* may be an example of one or more aspects of transmitter component 220 with reference to FIG. 2.

Figure 4:
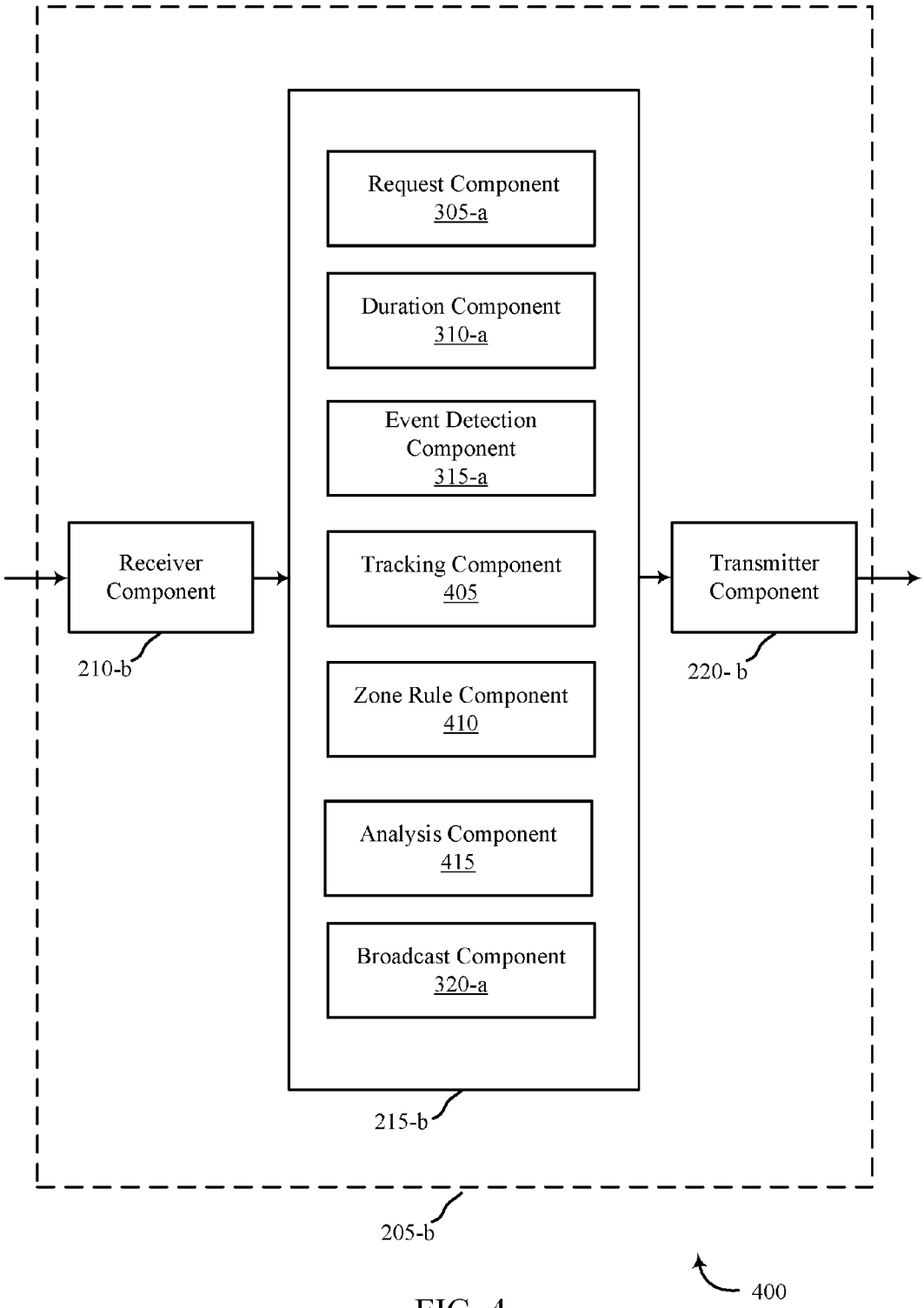
FIG. 4 shows a block diagram relating to an example security and automation system, in accordance with one or more aspects of the present disclosure.

FIG. 4 shows a block diagram 400 relating to an example a security and automation system, in accordance with one or more aspects of the present disclosure. The apparatus 205-*b* may be an example of one or more aspects of a control panel 135 described with reference to FIG. 1. The apparatus 205-*b* may include a receiver component 210-*b*, a false alarm reduction manager 215-*b*, and/or a transmitter component 220-*b*. The apparatus 205-*b* may be or include a processor. In some aspects, apparatus 205-*b* may be an example of one or more aspects of apparatus 205 or 205-*a* described with reference to FIGS. 2 and 3. Each of these components or modules may be in communication with each other—directly and/or indirectly. In one embodiment, where apparatus 205-*b* is a control panel, apparatus 205-*b* may be a control panel in the form of an interactive home automation system display. In some embodiments, apparatus 205-*b* may be a local computing device 120 such as a personal computer or portable electronic device (e.g., smart phone, smart watch, tablet computer). In some embodiments, apparatus 205-*b* may be coupled to at least one sensor unit 110.

In some examples, the false alarm reduction manager 215-*b*, may include request component 305-*a*, duration component 310-*a*, event detection component 315-*a*, tracking component 405, zone rule component 410, analysis component 415, and/or broadcast component 320-*a*. In some aspects, the false alarm reduction manager 215-*b* may be an example of one or more aspects of false alarm reduction manager 215 and 215-*a* described with reference to FIGS. 2 and 3. The components of the apparatus 205-*b* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver component 210-*b* may receive information such as packets, user data, and/or control information associated with various information channels (e.g., control channels, data channels, etc.). In some examples, the receiver component 210-*b* may be configured to receive instructions at the apparatus 205-*b*. In one aspect, the receiver component 210-*b* may be configured to receive instruction from local computing device 120 and/or remote computing device 140. In some examples, the received instruction may be in the form of a verbal command In further examples, the receiver component 210-*b* may receive identification information, location information and/or authentication credentials from the sensor units 110, local computing device 120, remote computing device 140, and/or server 155. In some examples, information (e.g., authentication credentials, location information) may be passed on to the false alarm reduction manager 215-*b*, and to other components of the apparatus 205-*b*. In some aspects, the receiver component 210-*b* may be an example of one or more aspects of the receiver component 210 or 210-*a* described with reference to FIGS. 2 and 3.

The receiver component 210-*a* may receive information such as packets, user data, and/or control information associated with various information channels (e.g., control channels, data channels). In some examples, the receiver component 210-*a* may be configured to receive instructions at the apparatus 205-*a*. In one aspect, the receiver component 210-*a* may be configured to receive instruction from local computing device 120 and/or remote computing device 140. In some examples, the received instruction may be in the form of a verbal command and/or by way of tactile input. In further examples, the receiver component 210-*a* may receive identification information, location information and/or authentication credentials from the sensor units 110, local computing device 120, remote computing device 140, and/or server 155. In some examples, information (e.g., authentication credentials, location information) may be passed on to the false alarm reduction manager 215-*a*, and to other components of the apparatus 205-*a*. In some aspects, the receiver component 210-*a* may be an example of one or more aspects of the receiver component 210-*a* described with reference to FIG. 2.

In some examples, the request component 305-*a* may receive a request to activate a security function associated with a home automation system. A security function may include, but is not limited to, arming and/or disarming alarm parameters, locking/un-locking a door, activate security cameras, lock/unlock windows, and the like. After receiving the instructions, the request component 305-*a* may forward one or more message to other components associated with the security and automation system for performing activating the security function. In some examples, the duration component 310-*a* may initiate a predetermined time (e.g., time delay) as one of the settings. The predetermined time may provide a duration where the property's security system is counting down before switching into an armed state.

In some cases, the duration component 310-*a* may receive information associated with detecting a person exiting the property, and based on detecting the person exiting the property, the duration component 310-*a* may initiate the predetermined time duration at that instance. In some examples, after predetermined time lapses, the security and automation system may be in an armed state. Additionally, in some cases, after the security and automation system switches into an armed state, the duration component 310-*a* may initiate a first security duration. A first security duration may include, but is not limited to, a timer or counter associated with the control panel 135 that is activated after the security and automation system is armed. In some cases, the first security duration may include a predetermined duration (e.g., 0 seconds to 120 seconds). In one embodiment, the first security duration may be associated with a default setting; for example, a default setting may be where a predetermined duration is two minutes. In other cases, broadcasting of any information associated with the first security duration (e.g., an audible and/or visual indication) thereof may be prevented, halted, and/or paused.

In some examples, an alarm zone may be associated with a first security parameter during a first security duration. Alternatively or additionally, an alarm zone may be associated with a second security parameter during a second security duration. For example, an entry or exit related to an alarm zone of a property during the first security duration may not trigger an alarm event. Alternatively, an entry or exit related to the same alarm zone during the second security duration may trigger an alarm event. In some examples, the event detection component 315-*a* may detect an occurrence of an event associated with the home automation system during the first security duration. Additionally, in some examples, one or more alarm zones may be associated with a different settings based on a corresponding security duration. For example, during a duration associated with the first security duration, event detection component 315-*a* associated with one or more alarm zones at a property may not trigger an alarm event even if an event is detected (e.g., motion, sound, entry/exit). Alternatively, in other embodiments, after the duration of the first security duration lapses, the event detection component 315-*a* associated with an alarm zone will no longer have any delay associated with it and may trigger an alarm event based on detecting an event (e.g., motion within the alarm zone). Additionally or alternatively, in some cases, during a duration associated with the first security duration, a person may re-enter the property, for example, because the person forgot to lock an inside door, close a window, turn off an appliance, a light, and/or forgot a personal item, and the like, while exiting. As a result, the re-entry of the person into the property during the first security duration may not trigger an alarm event.

In some examples, when the event detection component 315-*a* detects an entry into the property during a duration of the first security duration, the duration component 310-*a* may initiate a second security duration. The second security duration may include a predetermined duration (e.g., 0 seconds to 120 seconds, or n minutes or seconds where n is an integer value). In one embodiment, the second security duration may be associated with a default setting. A default setting, for example, may include that the predetermined duration be one minute. In one aspect, a home automation system may not broadcast audible or visual indicators displaying activation of the second security duration. In another aspect, a home automation system may broadcast audible and/or visual indicators, indicating activation of the second security duration. In some examples, initiating the second security duration based at least in part on the detecting comprises suspending the first security duration.

In some examples, the broadcast component 320-*a* may broadcast a message requesting authentication credentials at a location of the home automation system during the second security duration. For example, the broadcast component 320-*a* may display a timer and prompt a user to confirm disarming. In some embodiments, the broadcast component 320-*a* may broadcast an audible message associated with the second security duration based on detecting an entry into the property. For example, after detecting entry into the property, the broadcast component 320-*a* may display and/or broadcast a message, e.g., "Disarm System Now."

In some examples, zone rule component 410 may identify an alarm zone associated with an event, such an as entry event. In some examples, a property may include a plurality of alarm zones. In some aspects, the plurality of alarm zones may have an assigned priority level. For example, a first alarm zone may be associated with a first area of a property, e.g., a living room, kitchen, bedroom. Additionally, a second alarm zone may be associated with a second area of a property, e.g., children's bedroom. In some cases, one or more security functions associated with the security and automation system may be based on the identified alarm zone, assigned priority level of the identified alarm zone, or a combination thereof. In some cases, for example, an alarm zone associated with a children's room may have different security or alarm states based on detected events (i.e., entry events during a first security duration).

In some examples, broadcast component 320-*a* may request authentication credentials during the second security duration based at least in part on the alarm zone. For example, the security and automation system may request authentication credentials during the second security duration based on identifying that the alarm zone is a children's room. In some cases, the broadcast component 320-*a* may broadcast a visual message, an audible message, or a combination thereof requesting authentication credentials during the second security duration. In further cases, the broadcast component 320-*a* may broadcast an alarm sound associated with the second security duration.

In some examples, analysis component 415 may receive authentication credentials during the second security duration. In some cases, authentication credentials may be received from a local computing device (e.g., smartphone) carried by a person associated with the property. For example, a person may provide authentication credentials via an application running on the local computing device. In some examples, the application may be pre-installed and associated with the security and automation system of the property. In some examples, analysis component 415 may analyze authentication credentials based at least in part on comparing the authentication credentials to a set of pre-stored authentication credentials. In some cases, the security and automation system may be associated with a database of pre-stored authentication credentials. In an example, authentication credentials may be user-defined. In other examples, authentication credentials may be associated with biometric information, such as facial image recognition techniques, fingerprinting, eye scanning, motion signature (e.g., a person posture may be analyzed via sensor units 110 to pre-stored motion signature profiles associated with the security and automation system of the property such as gait), among others. In further examples, authentication credentials may be associated with a visual code (e.g., Quick Response (QR) code, bar code), or a RFID tag. In some examples, the analysis component 415 may suspend the security function based at least in part on the analyzing. In some cases, the analysis component 415 may receive an indication of failure to receive the authentication credentials during the second security duration. The analysis component 415 may activate a security function based at least in part on the second security duration lapsing, or receiving an indication of failure to receive the authentication credentials during the second security duration, or a combination thereof.

In some examples, broadcast component 320-*a* may transmit a message to a remote device based at least in part on an failure indication, the message including information associated with the identified alarm zone. In some cases, the message maybe transmitted to the local computing device 120 and/or the remote computing device 140 associated with the property, emergency personnel, and/or a preselected recipient (e.g., family member, neighbor). In some cases, the message may include information associated with a location of an event detected relative to the property. For example, a location associated with a detected entry (e.g., window, door) into the property. In some examples, broadcast component 320-*a* may send a notification to the local computing device 120 and/or remote computing device 140 of a person associated with the property after initiating the second security duration. In some examples, the broadcast component 320-*a* may receive a response from the remote device and activate a security function based at least in part on the response.

The transmitter component 220-*b* may transmit the one or more signals received from other components of the apparatus 205-*b*. The transmitter component 220-*b* may transmit information collected by sensors such as actions or behaviors, times of entry or exits associated with a property, and the like. In some examples, the transmitter component 220-*b* may be collocated with the receiver component 210-*b* in a transceiver module. In some aspects, transmitter component 220-*b* may be an example of one or more aspects of transmitter component 220 or 220-*a* with reference to FIGS. 2 and 3.

Figure 5:
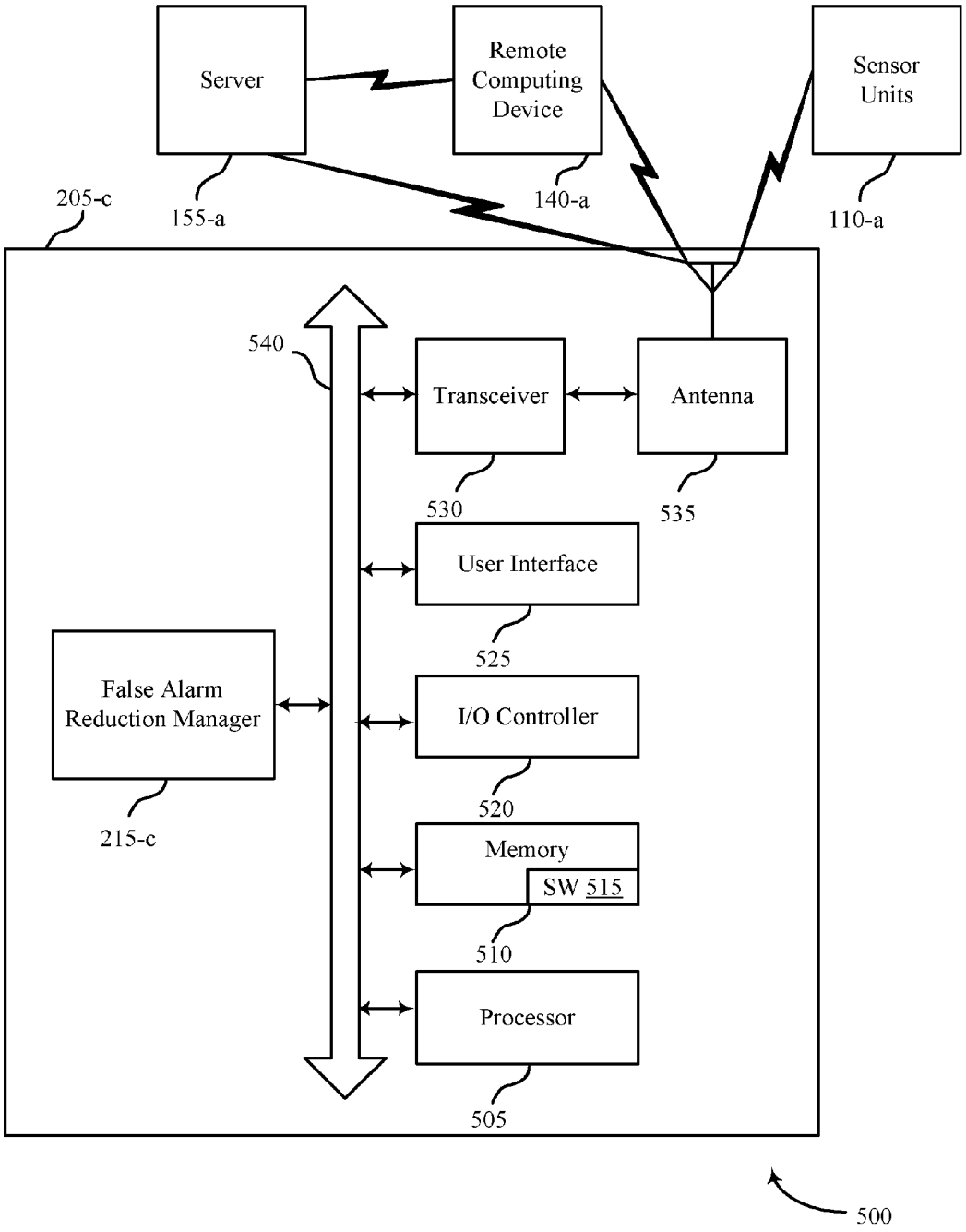
FIG. 5 shows a block diagram of an apparatus relating to an example security and automation system, in accordance with one or more aspects of the present disclosure.

FIG. 5 shows a block diagram 500 of an apparatus 205-*c* relating to a security and automation system, in accordance with one or more aspects of the present disclosure. Apparatus 205-*c* may be an example of the control panel 135, local computing device 120, and/or the sensor units 110 of FIG. 1. In some examples, apparatus 205-*c* may also be an example of one or more aspects of apparatus 205, 205-*a*, and/or 205-*b* with reference to FIGS. 2-4.

Apparatus 205-*c* may include a false alarm reduction manager 215-*c*, which may be an example of the false alarm reduction manager 215-*a* and/or 215-*a* described with reference to FIGS. 2 and 3. The false alarm reduction manager 215-*c* may provide techniques for reducing false alarms associated with a security and automation system by applying parameters to events that trigger an alarm and/or parameters to settings of the security and automation system, as described above with reference to FIGS. 1-4.

Apparatus 205-*c* may also include components for bi-directional data communications including components for transmitting communications and components for receiving communications. For example, apparatus 205-*c* may communicate bi-directionally with remote computing device 140-*a*, server 155-*a*, or sensor units 110-*a*. This bi-directional communication may be direct (e.g., apparatus 205-*c* communicating directly with sensor units 110-*a* or remote computing device 140-*a*) or indirect (e.g., apparatus 205-*b* communicating with remote computing device 140-*a* via server 155-*a*). Server 155-*a*, remote computing device 140-*a*, and sensor units 110-*a* may be examples of server 155, remote computing device 140, and sensor units 110 as shown with respect to FIG. 1.

Apparatus 205-*c* may also include a processor 505, and memory 510 (including software (SW) 515), an input/output (I/O) controller 520, a user interface 525, a transceiver 530, and one or more antennas 535, each of which may communicate—directly or indirectly—with one another (e.g., via one or more buses 540). The transceiver 530 may communicate bi-directionally—via the one or more antennas 535, wired links, and/or wireless links—with one or more networks or remote devices as described above. For example, the transceiver 530 may communicate bi-directionally with one or more of server 155-*a* or sensor unit 110-*a*. The transceiver 530 may include a modem to modulate the packets and provide the modulated packets to the one or more antennas 535 for transmission, and to demodulate packets received from the one or more antennas 535. While an apparatus 205-*c* may include a single antenna 535, the apparatus may also have multiple antennas 535 capable of concurrently transmitting or receiving multiple wired and/or wireless transmissions. In some embodiments, one element of apparatus 205-*c* (e.g., one or more antennas 535, transceiver 530, etc.) may provide a direct connection to a server 155-*a* via a direct network link to the Internet via a POP (point of presence). In some embodiments, one element of apparatus 205-*c* (e.g., one or more antennas 535, transceiver 530, etc.) may provide a connection using wireless techniques, including digital cellular telephone connection, Cellular Digital Packet Data (CDPD) connection, digital satellite data connection, and/or another connection.

The signals associated with apparatus 205-*c*, server 155-*a*, remote computing device 140-*a*, and/or sensor unit 110-*a* may include wireless communication signals such as radio frequency, electromagnetics, local area network (LAN), wide area network (WAN), virtual private network (VPN), wireless network (using 802.11, for example), 345 MHz, Z Wave, cellular network (using 3G and/or LTE, for example), and/or other signals. The one or more antennas 535 and/or transceiver 530 may include or be related to, but are not limited to, wireless wide area network (WWAN) (GSM, CDMA, and WCDMA), WLAN (including Bluetooth and Wi-Fi), WMAN (WiMAX), antennas for mobile communications, antennas for Wireless Personal Area Network (WPAN) applications (including radio-frequency identification (RFID) and ultra-wideband (UWB)). In some embodiments, each antenna 535 may receive signals or information specific and/or exclusive to itself. In other embodiments each antenna 535 may receive signals or information neither specific nor exclusive to itself.

In some embodiments, the user interface 525 may include an audio device, such as an external speaker system, a visual device such as a camera or video camera, an external display device such as a display screen, and/or an input device (e.g., remote control device interfaced with the user interface 525 directly and/or through I/O controller 520). In some examples, one or more buses 540 may allow data communication between one or more elements of apparatus 205-*c* (e.g., processor 505, memory 510, I/O controller 520, user interface 525, etc.).

The memory 510 may include random access memory (RAM), read only memory (ROM), flash RAM, and/or other types. The memory 510 may store computer-readable, computer-executable software/firmware code 515 including instructions that, when executed, cause the processor 505 to perform various functions described in this disclosure (e.g., analyzing the authentication credentials, transmitting a message to a remote device, etc.). Alternatively, the computer-executable software/firmware code 515 may not be directly executable by the processor 505 but may cause a computer (e.g., when compiled and executed) to perform functions described herein.

In some embodiments the processor 505 may include, among other things, an intelligent hardware device (e.g., a central processing unit (CPU), a microcontroller, and/or an ASIC, etc.). The memory 510 may contain, among other things, the Basic Input-Output system (BIOS) which may control basic hardware and/or software operation such as the interaction with peripheral components or devices. For example, the false alarm reduction manager 215-*c* may be stored within the memory 510. Applications resident with apparatus 205-*c* are generally stored on and accessed via a non-transitory computer readable medium, such as a hard disk drive or other storage medium. Additionally, applications may be in the form of electronic signals modulated in accordance with the application and data communication technology when accessed via a network interface (e.g., transceiver 530, one or more antennas 535, etc.).

Many other devices and/or subsystems may be connected to, or may be included as, one or more elements of apparatus 205-*c* (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 5 need not be present to practice the present systems and methods. The devices and subsystems can be interconnected in different ways from that shown in FIG. 5. In some embodiments, an aspect of some operation of a system, such as that shown in FIG. 5, may be readily known in the art and is not discussed in detail in this disclosure. Code to implement the present disclosure may be stored in a non-transitory computer-readable medium such as one or more of memory 510 or other memory. The operating system provided on I/O controller 520 may be iOS®, ANDROID®, MS-dOS®, MS-WINDOWS®, OS/2®, UNIX®, LINUX®, or another known operating system.

The components of the apparatus 205-*c* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Figure 6:
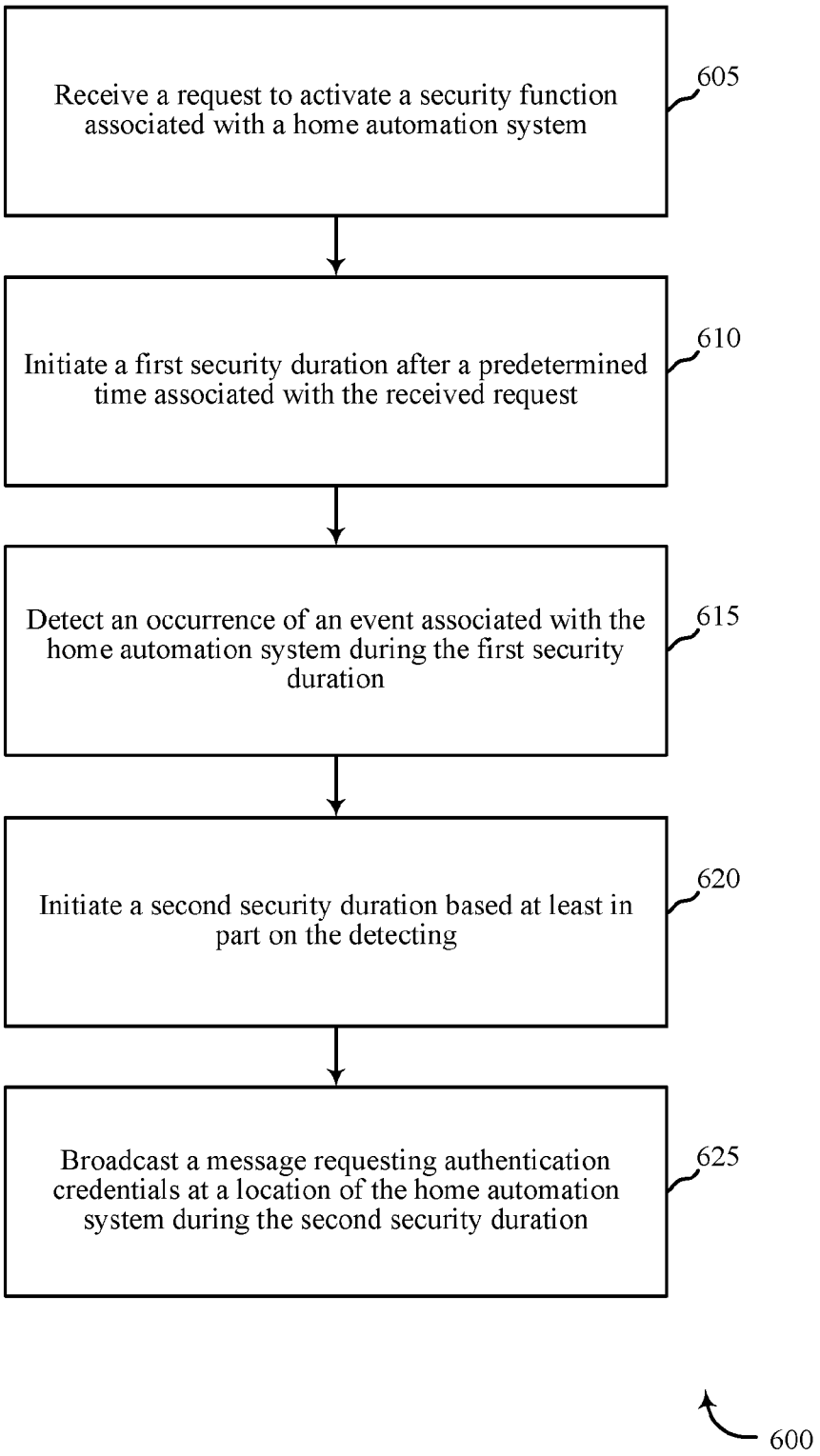
FIG. 6 is a flow chart illustrating an example of a method relating to a security and automation system, in accordance with one or more aspects of the present disclosure.

FIG. 6 is a flow chart illustrating an example of a method 600 relating to a security and/or an automation system, in accordance with one or more aspects of the present disclosure. For clarity, the method 600 is described below with reference to aspects of one or more of the sensor units 110, local computing device 120, control panel 135, and/or remote computing device 140 as described with reference to at least FIG. 1. In addition, method 600 is described below with reference to aspects of one or more of the apparatus 205, 205-*a*, 205-*b*, or 205-*c* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 605, the method 600 may include receiving a request to activate a security function associated with a home automation system. A security function may include, but is not limited to, arming and/or disarming alarm parameters, locking/un-locking a door, activating security cameras, locking/unlocking windows, and the like. The operation at block 605 may be performed using the false alarm reduction manager 215, control panel 135, sensor units 110, or apparatus 205, described with reference to FIGS. 1-5. In some aspects, the operation at block 605 may be performed, additionally or alternatively, using the request component 305 or the request component 305-*a*, described with reference to FIGS. 3 and 4.

At block 610, the method 600 may include initiating a first security duration after a predetermined time associated with the received request. A first security duration may include, but is not limited to, a timer or counter associated with the control panel 135 that is activated after the security and automation system 100 is armed. The operation at block 610 may be performed using the false alarm reduction manager 215, control panel 135, sensor units 110, or apparatus 205, described with reference to FIGS. 1-5. In some aspects, the operation at block 610 may be performed, additionally or alternatively, using the duration component 310 or the duration component 310-*a*, described with reference to FIGS. 3 and 4.

At block 615, the method 600 may include detecting an occurrence of an event associated with the home automation system during the first security duration. In some examples, an event may include a person re-entering or exiting a property during the first security duration. In one aspect, the occurrence of the event may be within a property (e.g., home). The operation at block 615 may be performed using the false alarm reduction manager 215, control panel 135, sensor units 110, or apparatus 205, described with reference to FIGS. 1-5. In some aspects, the operation at block 615 may be performed, additionally or alternatively, using the event detection component 315 or the event detection component 315-*a*, described with reference to FIGS. 3 and 4.

At block 620, the method 600 may include initiating a second security duration based at least in part on the detecting. In some cases, the second security duration may include a predetermined amount of time for a person to perform an authentication action. The operation at block 620 may be performed using the false alarm reduction manager 215, control panel 135, sensor units 110, or apparatus 205, described with reference to FIGS. 1-5. In some aspects, the operation at block 620 may be performed, additionally or alternatively, using the duration component 310 or the duration component 310-*a*, described with reference to FIGS. 3 and 4.

At block 625, the method 600 may include broadcasting a message requesting authentication credentials at a location of the home automation system during the second security duration. Alternatively, for example, the control panel 135 may broadcast or display information associated with the second security duration. For instance, the control panel 135 may display a timer and prompt a disarm screen. In some embodiments, the control panel 135 may broadcast an audible message associated with the second security duration based on detecting an entry into the property. The operation at block 625 may be performed using the false alarm reduction manager 215, control panel 135, sensor units 110, or apparatus 205, described with reference to FIGS. 1-5. In some aspects, the operation at block 625 may be performed, additionally or alternatively, using the broadcast component 320 or the broadcast component 320-*a*, described with reference to FIGS. 3 and 4.

Figure 7:
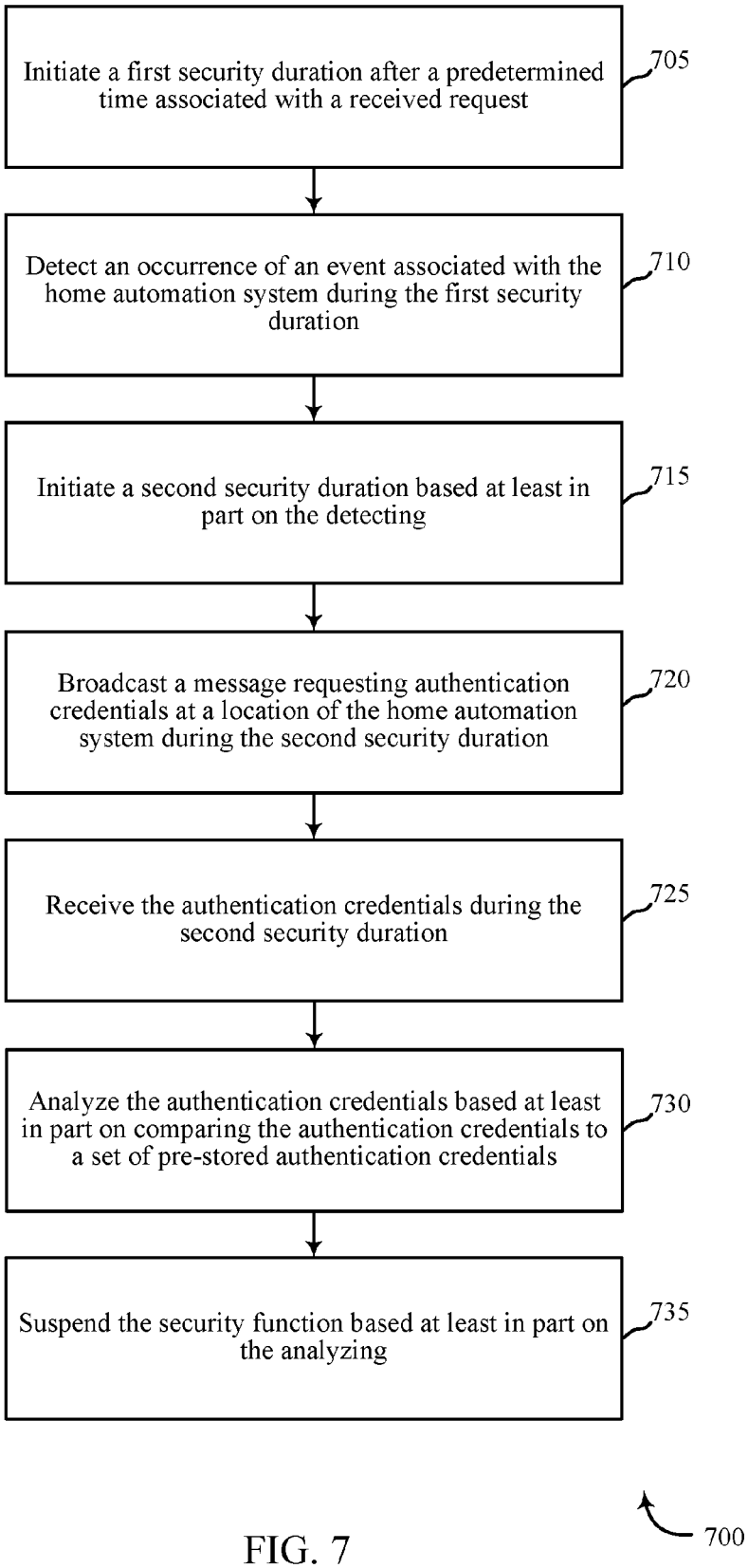
FIG. 7 is a flow chart illustrating an example of a method relating to a security and automation system, in accordance with one or more aspects of the present disclosure.

FIG. 7 is a flow chart illustrating an example of a method 700 relating to a security and automation system, in accordance with one or more aspects of the present disclosure. For clarity, the method 700 is described below with reference to aspects of one or more of the sensor units 110, local computing device 120, control panel 135, and/or remote computing device 140 as described with reference to at least FIG. 1. In addition, method 700 is described below with reference to aspects of one or more of the apparatus 205, 205-*a*, 205-*b*, or 205-*c* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 705, the method 700 may include initiating a first security duration after a predetermined time associated with the received request. A first security duration may include, but is not limited to, a timer or counter associated with the control panel 135 that is activated after the security and automation system 100 is armed. In some cases, the first security duration may include a predetermined duration (e.g., 0 seconds to 120 seconds). In one embodiment, the first security duration may be associated with a default setting. For example, a default setting may include, but is not limited to, the predetermined duration being 2 minutes. In some examples, a home automation system is absent to any audible or visual indicators displaying activation of the first security duration. The operation at block 705 may be performed using the false alarm reduction manager 215, control panel 135, sensor units 110, or apparatus 205, described with reference to FIGS. 1-5. In some aspects, the operation at block 705 may be performed, additionally or alternatively, using the duration component 310 or the duration component 310-*a*, described with reference to FIGS. 3 and 4.

At block 710, the method 700 may include detecting an occurrence of an event associated with the home automation system during the first security duration. In some examples, an event may include a person re-entering or exiting a property during the first security duration. In some examples, the home automation system may track a frequency of entries and exits during the first security duration. In some examples, the tracked frequency of entries and exits may be stored in memory located at the control panel 135 or server 155. In some examples, the security and automation system (or home automation system) generates a behavioral model of the frequency of entries and exits during a security duration (e.g., first security duration, second security duration). In some examples, the behavioral model may be applied one or more components of the security and automation system to evaluate an event detected at a property associated with the security and automation system. The operation at block 710 may be performed using the false alarm reduction manager 215, control panel 135, sensor units 110, or apparatus 205, described with reference to FIGS. 1-5. In some aspects, the operation at block 710 may be performed, additionally or alternatively, using the event detection component 315 or the event detection component 315-*a*, described with reference to FIGS. 3 and 4.

At block 715, the method 700 may include initiating a second security duration based at least in part on the detecting. In some cases, the second security duration may include a predetermined duration (e.g., 0 seconds to 120 seconds). In one embodiment, the second security duration may be associated with a default setting. The operation at block 715 may be performed using the false alarm reduction manager 215, control panel 135, sensor units 110, or apparatus 205, described with reference to FIGS. 1-5. In some aspects, the operation at block 715 may be performed, additionally or alternatively, using the duration component 310 or the duration component 310-*a*, described with reference to FIGS. 3 and 4.

At block 720, the method 700 may include broadcasting a message requesting authentication credentials at a location of the home automation system during the second security duration. The operation at block 720 may be performed using the false alarm reduction manager 215, control panel 135, sensor units 110, or apparatus 205, described with reference to FIGS. 1-5. In some aspects, the operation at block 720 may be performed, additionally or alternatively, using the broadcast component 320 or the broadcast component 320-*a*, described with reference to FIGS. 3 and 4.

At block 725, the method 700 may include receiving the authentication credentials during the second security duration. In some cases, authentication credentials may be received from a local computing device (e.g., smartphone) carried by a person with the property. For example, a person may provide authentication credentials via an application running on the local computing device. In some examples, the application may be pre-installed and associated with the security and automation system of the property. The operation at block 725 may be performed using the false alarm reduction manager 215, control panel 135, sensor units 110, or apparatus 205, described with reference to FIGS. 1-5. In some aspects, the operation at block 725 may be performed, additionally or alternatively, using the analysis component 415, described with reference to FIG. 4.

At block 730, the method 700 may include analyzing the authentication credentials based at least in part on comparing the authentication credentials to a set of pre-stored authentication credentials. In some cases, the security and automation system may be associated with a database of pre-stored authentication credentials. In an example, authentication credentials may be user-defined. In other examples, authentication credentials may be associated with facial image recognition techniques, biometric information, motion signature (e.g., a person posture may be analyzed via sensor units 110 to pre-stored motion signature profiles associated with the security and automation system of the property), among others. The operation at block 730 may be performed using the false alarm reduction manager 215, control panel 135, sensor units 110, or apparatus 205, described with reference to FIGS. 1-5. In some aspects, the operation at block 730 may be performed, additionally or alternatively, using the analysis component 415, described with reference to FIG. 4.

At block 735, the method 700 may include suspending the security function based at least in part on the analyzing. The operation at block 735 may be performed using the false alarm reduction manager 215, control panel 135, sensor units 110, or apparatus 205, described with reference to FIGS. 1-5.

Figure 8:
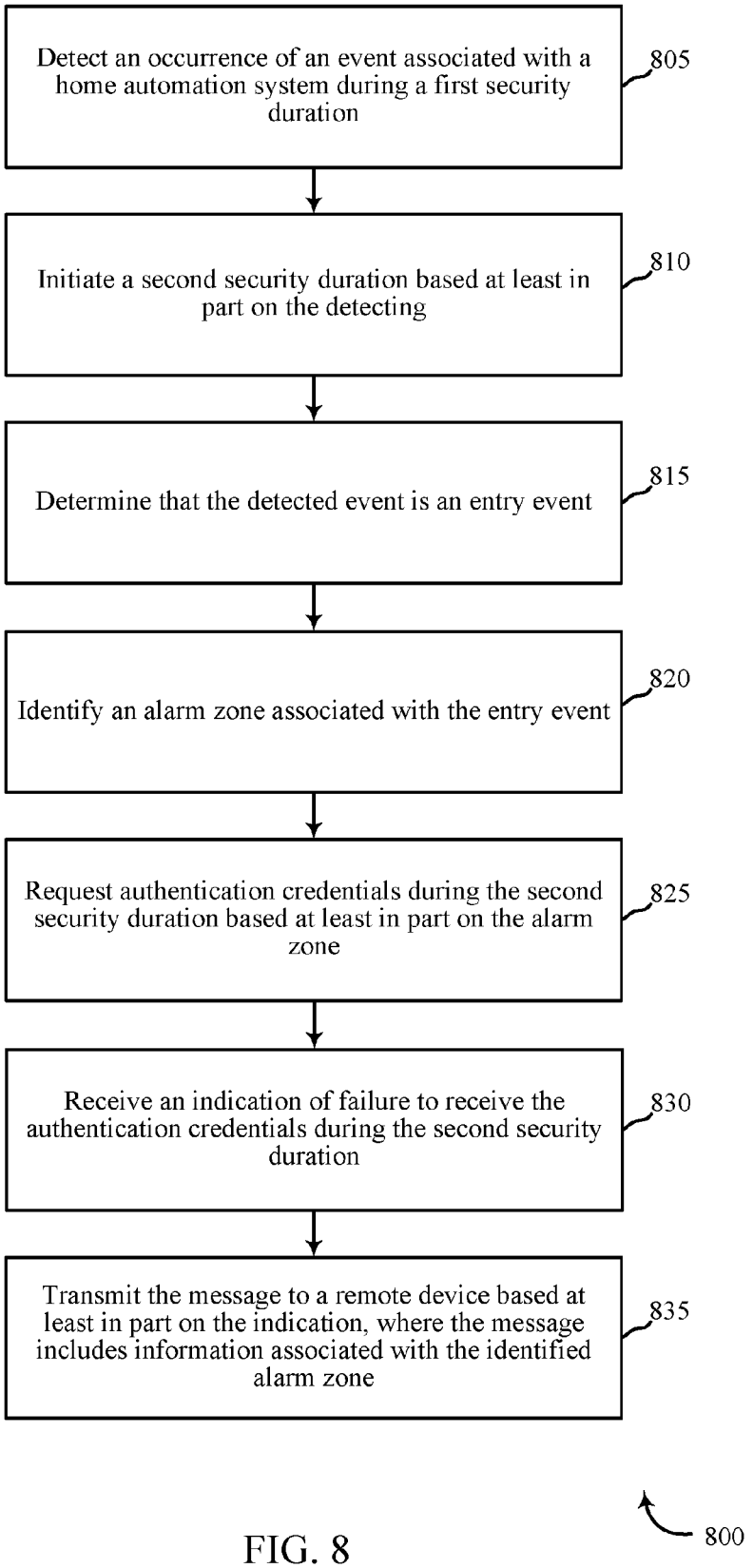
FIG. 8 is a flow chart illustrating an example of a method relating to a security and automation system, in accordance with one or more aspects of the present disclosure.

FIG. 8 is a flow chart illustrating an example of a method 800 relating to a security and/or an automation system, in accordance with one or more aspects of the present disclosure. For clarity, the method 800 is described below with reference to aspects of one or more of the sensor units 110, local computing device 120, control panel 135, and/or remote computing device 140 as described with reference to at least FIG. 1. In addition, method 800 is described below with reference to aspects of one or more of the apparatus 205, 205-*a*, 205-*b*, or 205-*c* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 805, the method 800 may include detecting an occurrence of an event associated with a home automation system during a first security duration. In some examples, an event may include a person re-entering a property during the first security duration. In one aspect, the occurrence of the event may be within a property. In another aspect, the occurrence of the event may be within a predetermined boundary outside of the property. The operation at block 805 may be performed using the false alarm reduction manager 215, control panel 135, sensor units 110, or apparatus 205, described with reference to FIGS. 1-5. In some aspects, the operation at block 805 may be performed, additionally or alternatively, using the event detection component 315 or the event detection component 315-*a*, described with reference to FIGS. 3 and 4.

At block 810, the method 800 may include initiating a second security duration based at least in part on the detecting. The second security duration may include a predetermined duration (e.g., 0 seconds to 120 seconds, or n minutes or seconds where n is an integer value). In one embodiment, the second security duration may be associated with a default setting. A default setting, for example, may include that the predetermined duration be 1 minute. In one aspect, a home automation system is absent to any audible or visual indicators displaying activation of the second security duration. In another aspect, a home automation system is broadcasts audible or visual indicators, or a combination thereof, indicating activation of the second security duration. The operation at block 810 may be performed using the false alarm reduction manager 215, control panel 135, sensor units 110, or apparatus 205, described with reference to FIGS. 1-5. In some aspects, the operation at block 810 may be performed, additionally or alternatively, using the duration component 310 or the duration component 310-*a*, described with reference to FIGS. 3 and 4.

At block 815, the method 800 may include determining that the detected event is an entry event. In some examples, an entry event may include a person entering a property during the first security duration or the second security duration, or a combination thereof. In another aspect, the entry event may be within a predetermined boundary outside of the property. Additionally, in some examples, the detected event may be based on detecting an empty status at the property and then subsequently a person entering the property during a first security duration, second security duration, or a combination thereof. The operation at block 815 may be performed using the false alarm reduction manager 215, control panel 135, sensor units 110, or apparatus 205, described with reference to FIGS. 1-5. In some aspects, the operation at block 815 may be performed, additionally or alternatively, using the event detection component 315, or the event detection component 315-*a*, or the tracking component 405, and/or the zone rule component 410, described with reference to FIGS. 3 and 4.

At block 820, the method 800 may include identifying an alarm zone associated with the entry event. In some examples, a property may include a plurality of alarm zones. In some aspects, the plurality of alarm zones may have an assigned priority level. For example, a first alarm zone may be associated with a first area of a property, e.g., a living room, kitchen, bedroom. Additionally, a second alarm zone may be associated with a second area of a property, e.g., children's bedroom. In some examples, an alarm zone may be associated with a first security parameter during a first security duration. Alternatively or additionally, an alarm zone may be associated with a second security parameter during a second security duration. For example, an entry or exit related to an alarm zone of a property during the first security duration may not trigger an alarm event. Alternatively, an entry or exit related to the same alarm zone during the second security duration may trigger an alarm event. In some cases, one or more security functions associated with the security and automation system may be based on the identified alarm zone, assigned priority level of the identified alarm zone, or a combination thereof. In some cases, for example, an alarm zone associated with a children's room may have a different security or alarm states based on detected events (i.e., entry events during a first security duration). In some examples, an alarm zone may transition in and out of different security states based on a time of day, or detected event, among others. The operation at block 820 may be performed using the false alarm reduction manager 215, control panel 135, sensor units 110, or apparatus 205, described with reference to FIGS. 1-5. In some aspects, the operation at block 820 may be performed, additionally or alternatively, using the tracking component 405 and/or the zone rule component 410, described with reference to FIG. 4.

At block 825, the method 800 may include requesting the authentication credentials during the second security duration based at least in part on the alarm zone. For example, the security and automation system may request authentication credentials during the second security duration based on identifying that the alarm zone is a children's room. In some cases, the control panel 135 may broadcast a visual message, an audible message, or a combination thereof requesting authentication credentials during the second security duration. In further cases, the control panel 135 may broadcast an alarm sound associated with the second security duration. The operation at block 825 may be performed using the false alarm reduction manager 215, control panel 135, sensor units 110, or apparatus 205, described with reference to FIGS. 1-5. In some aspects, the operation at block 825 may be performed, additionally or alternatively, using the analysis component 415, described with reference to FIG. 4.

At block 830, the method 800 may include receiving an indication of failure to receive the authentication credentials during the second security duration. The operation at block 830 may be performed using the false alarm reduction manager 215, control panel 135, sensor units 110, or apparatus 205, described with reference to FIGS. 1-5. In some aspects, the operation at block 830 may be performed, additionally or alternatively, using the analysis component 415, described with reference to FIG. 4.

At block 835, the method 800 may include transmitting the message to a remote device based at least in part on the indication, the message including information associated with the identified alarm zone. In some cases, the message maybe transmitted to the local computing device 120 and/or the remote computing device 140 associated with the property and/or an emergency personnel. In some cases, the message may include information associated with a location of an event detected relative to the property. For example, a location associated with a detected entry (e.g., window, door) into the property. In some embodiments, the control panel 135 may send a notification to the local computing device 120 and/or remote computing device 140 of a person associated with the property after initiating the second security duration. The operation at block 835 may be performed using the false alarm reduction manager 215, control panel 135, sensor units 110, or apparatus 205, described with reference to FIGS. 1-5. In some aspects, the operation at block 835 may be performed, additionally or alternatively, using the broadcast component 320 or the broadcast component 320-*a*, described with reference to FIGS. 3 and 4.

Figure 9:
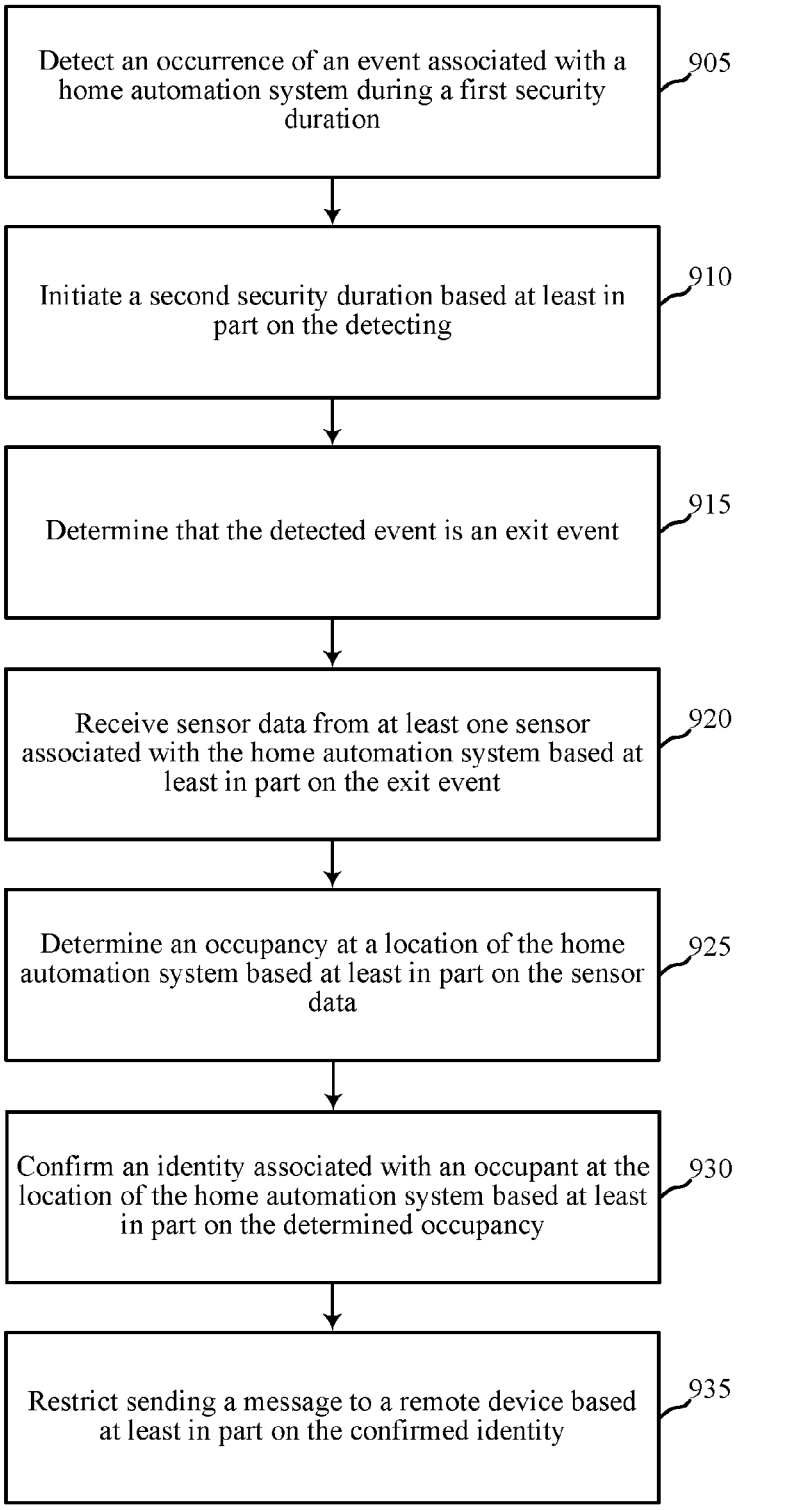
FIG. 9 is a flow chart illustrating an example of a method relating to a security and automation system, in accordance with one or more aspects of the present disclosure.

FIG. 9 is a flow chart illustrating an example of a method 900 relating to a security and/or automation system, in accordance with one or more aspects of the present disclosure. For clarity, the method 900 is described below with reference to aspects of one or more of the sensor units 110, local computing device 120, control panel 135, and/or remote computing device 140 as described with reference to at least FIG. 1. In addition, method 900 is described below with reference to aspects of one or more of the apparatus 205, 205-*a*, 205-*b*, or 205-*c* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 905, the method 900 may include detecting an occurrence of an event associated with a home automation system during a first security duration. In some examples, an event may include a person exiting a property during the first security duration. In one aspect, the occurrence of the event may be within a property (e.g., home). In another aspect, the occurrence of the event may be within a predetermined boundary outside of the property. The operation at block 905 may be performed using the false alarm reduction manager 215, control panel 135, sensor units 110, or apparatus 205, described with reference to FIGS. 1-5. In some aspects, the operation at block 905 may be performed, additionally or alternatively, using the event detection component 315 or the event detection component 315-*a*, described with reference to FIGS. 3 and 4.

At block 910, the method 900 may include initiating a second security duration based at least in part on the detecting. In some cases, the second security duration may include a predetermined duration (e.g., 0 seconds to 120 seconds). In one embodiment, the second security duration may be associated with a default setting. A default setting, for example, may include that the predetermined duration be 2 minutes. The operation at block 910 may be performed using the false alarm reduction manager 215, control panel 135, sensor units 110, or apparatus 205, described with reference to FIGS. 1-5. In some aspects, the operation at block 910 may be performed, additionally or alternatively, using the duration component 310 or the duration component 310-*a*, described with reference to FIGS. 3 and 4.

At block 915, the method 900 may include determining that the detected event is an exit event. In some examples, an exit event may include a person exiting a property during the first security duration or the second security duration, or a combination thereof. In another aspect, the exit event may be within a predetermined boundary outside of the property. The operation at block 915 may be performed using the false alarm reduction manager 215, control panel 135, sensor units 110, or apparatus 205, described with reference to FIGS. 1-5. In some aspects, the operation at block 915 may be performed, additionally or alternatively, using the event detection component 315, or the event detection component 315-*a*, or the tracking component 405, and/or the zone rule component 410, described with reference to FIGS. 3 and 4.

At block 920, the method 900 may include receiving sensor data from at least one sensor associated with the home automation system based at least in part on the exit event. In some examples, the presence may be detected by actions performed in or outside a property, or by detecting occupants at the property and subsequently the occupants exiting the property. In an example, the at least one sensor may be linked to a door sensor or window sensor which may detect when a door or window to a property (e.g., residence) is opened and when a person exits the property. In some examples, a person may be a sole occupant of the house, or may join other occupants currently present at the property. The operation at block 920 may be performed using the false alarm reduction manager 215, control panel 135, sensor units 110, or apparatus 205, described with reference to FIGS. 1-5. In some aspects, the operation at block 920 may be performed, additionally or alternatively, using the event detection component 315, or the event detection component 315-*a*, or the tracking component 405, and/or the zone rule component 410, described with reference to FIGS. 3 and 4.

At block 925, the method 900 may include determining an occupancy at the location of the home automation system based at least in part on the sensor data. In some examples, a property may include a motion sensor, heartbeat sensor, breathing sensor, vibration sensor, or any other known occupancy detection means, to detect the presence of a person at or near a property. In some examples, occupancy may alternatively be manually inputted by a person using a local computing device such as a smartphone, or may be automatically detected by a location sensor integrated with the local computing device or by a communication between the local computing device and another component (e.g., control panel). In some examples, occupancy may be determined based on sensor data indicating that there is movement in the kitchen, or that a smartphone signal is being detected in a bedroom. In some embodiments, detected occupancy may be communicated to a remote computing device, such as a central security operating station or a personal computing device of a third party caller, where the occupancy may be displayed, for example in the form of a list, or in the form of a map of the home or property. The operation at block 925 may be performed using the false alarm reduction manager 215, control panel 135, sensor units 110, or apparatus 205, described with reference to FIGS. 1-5. In some aspects, the operation at block 925 may be performed, additionally or alternatively, using the event detection component 315, or the event detection component 315-*a*, or the tracking component 405, and/or the zone rule component 410, described with reference to FIGS. 3 and 4.

At block 930, the method 900 may include confirming an identity associated with an occupant at the location of the home automation system based at least in part on the determined occupancy. In some examples, a person's identity may be determined based on identifying the location of a portable electronic device, belonging to a person associated with the home automation system, through global positioning systems (GPS). Additionally or alternatively, an identity of a person may be confirmed using a retinal scanner, a fingerprint scanner, a voiceprint sensor, a camera calibrated to identify facial structure, a GPS receiver or a input device (e.g. a keypad) into which a user may input a personal identification number (PIN) or any other known identification detection means to detect the occupancy of a person and to determine the person's identity at or near a property, for example, at a control panel located within or outside of the home. In some examples, an identity of a person may be confirmed by capturing an image of a person at the property via a camera unit (e.g., within sensor units 110). The captured image may be compared to a database associated with pre-stored profiles. In some examples, the pre-stored profiles are personnel profiles of individuals associated with the property. The operation at block 930 may be performed using the false alarm reduction manager 215, control panel 135, sensor units 110, or apparatus 205, described with reference to FIGS. 1-5. In some aspects, the operation at block 930 may be performed, additionally or alternatively, using the analysis component 415, described with reference to FIG. 4.

At block 935, the method 900 may include terminating the message based at least in part on the confirmed identity. The operation at block 935 may be performed using the false alarm reduction manager 215, control panel 135, sensor units 110, or apparatus 205, described with reference to FIGS. 1-5. In some aspects, the operation at block 935 may be performed, additionally or alternatively, using the broadcast component 320 or the broadcast component 320-*a*, described with reference to FIGS. 3 and 4.

In some examples, aspects from two or more of the methods 600, 700, 800, and 900 may be combined and/or separated. It should be noted that the methods 600, 700, 800, and 900 are just example implementations, and that the operations of the methods 700-900 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for reducing false alarms of a security and automation system, comprising:

receiving, via a processor of a control panel, a request to activate a security function associated with an automation system;

detecting, via the processor of the control panel, a person exiting a structure associated with the automation system during a predetermined time based at least in part on received sensor data, the predetermined time being a threshold duration for the person to exit the structure before the automation system transitions into a secure state;

determining, via the processor of the control panel, an occupancy associated with the structure, the occupancy indicating whether another person is within the structure;

initiating, via the processor of the control panel, a first security duration after the predetermined time and determining the structure is unoccupied based at least in part on the determined occupancy;

detecting, via the processor of the control panel, an occurrence of an event associated with the automation system during the first security duration;

bypassing, via the processor of the control panel, triggering an alarm event associated with the detected occurrence of the event during the first security duration;

initiating, via the processor of the control panel, a second security duration based at least in part on the detecting; and broadcasting, via the processor of the control panel, a message requesting authentication credentials at a location of the automation system during the second security duration.

2. The method of claim 1, further comprising:

performing the security function based at least in part on the first security duration, the second security duration, or a combination thereof.

3. The method of claim 1, wherein initiating the second security duration based at least in part on the detecting comprises suspending the first security duration.

4. The method of claim 1, further comprising:

receiving the authentication credentials during the second security duration;

analyzing the authentication credentials based at least in part on comparing the authentication credentials to a set of pre-stored authentication credentials; and suspending the security function based at least in part on the analyzing.

5. The method of claim 1, further comprising:

activating the security function based at least in part on the second security duration lapsing, or receiving an indication of failure to receive the authentication credentials during the second security duration, or a combination thereof.

6. The method of claim 1, further comprising:

transmitting the message to a remote device associated with the automation system;

receiving a response message from the remote device; and activating the security function based at least in part on receiving the response message.

7. The method of claim 1, wherein the location of the automation system comprises a plurality of alarm zones.

8. The method of claim 7, further comprising:

assigning a priority level to each alarm zone of the plurality of alarm zones.

9. The method of claim 1, further comprising:

determining that the detected event is an entry event;

identifying an alarm zone associated with the entry event; and requesting the authentication credentials during the second security duration based at least in part on the alarm zone.

10. The method of claim 9, wherein the alarm zone is associated with a first security parameter during the first security duration.

11. The method of claim 9, wherein the alarm zone is associated with a second security parameter during the second security duration.

12. The method of claim 11, wherein the first security parameter is different from the second security parameter.

13. The method of claim 9, further comprising:

receiving an indication of failure to receive the authentication credentials during the second security duration; and transmitting the message to a remote device based at least in part on the indication, the message including information associated with the identified alarm zone.

14. The method of claim 1, further comprising:

determining that the detected event is an exit event;

receiving sensor data from at least one sensor associated with the automation system based at least in part on the exit event; and determining an occupancy at the location of the automation system based at least in part on the sensor data.

15. The method of claim 14, further comprising performing the security function based at least in part on the exit event, or the occupancy, or the second security duration lapsing, or a combination thereof.

16. The method of claim 14, further comprising:

confirming an identity associated with an occupant at the location of the automation system based at least in part on the determined occupancy; and terminating the message based at least in part on the confirmed identity.

17. The method of claim 1, wherein the message comprises any of an audio message, or a video message, or a combination thereof.

18. An apparatus for security and/or automation systems, comprising:

a processor;

memory in electronic communication with the processor; and instructions stored in the memory, the instructions being executable by the processor to:

receive a request to activate a security function associated with an automation system;

detect a person exiting a structure associated with the automation system during a predetermined time based at least in part on received sensor data, the predetermined time being a threshold duration for the person to exit the structure before the automation system transitions into a secure state;

determine an occupancy associated with the structure, the occupancy indicating whether another person is within the structure;

initiate a first security duration after the predetermined time and determining the structure is unoccupied based at least in part on the determined occupancy;

detect an occurrence of an event associated with the automation system during the first security duration;

bypass triggering an alarm event associated with the detected occurrence of the event during the first security duration;

initiate a second security duration based at least in part on the detecting; and broadcast a message requesting authentication credentials at a location of the automation system during the second security duration.

19. The apparatus of claim 18, wherein the instructions are further executable by the processor to:

perform the security function based at least in part on the first security duration, the second security duration, or a combination thereof.

20. A non-transitory computer-readable medium storing computer-executable code, the code executable by a processor to:

receive a request to activate a security function associated with an automation system;

detect a person exiting a structure associated with the automation system during a predetermined time based at least in part on received sensor data, the predetermined time being a threshold duration for the person to exit the structure before the automation system transitions into a secure state;

determine an occupancy associated with the structure, the occupancy indicating whether another person is within the structure;

initiate a first security duration after the predetermined time and determining the structure is unoccupied based at least in part on the determined occupancy;

detect an occurrence of an event associated with the automation system during the first security duration;

bypass triggering an alarm event associated with the detected occurrence of the event during the first security duration;

initiate a second security duration based at least in part on the detecting; and broadcast a message requesting authentication credentials at a location of the automation system during the second security duration.

* * * * *